US009298148B2

(12) United States Patent
Wakai

(10) Patent No.: US 9,298,148 B2
(45) Date of Patent: Mar. 29, 2016

(54) PRINTING APPARATUS, METHOD OF CONTROLLING PRINTING APPARATUS, AND STORAGE MEDIUM

(71) Applicant: CANON KABUSHIKI KAISHA, Tokyo (JP)

(72) Inventor: Kazuo Wakai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/630,287

(22) Filed: Feb. 24, 2015

(65) Prior Publication Data

US 2015/0241829 A1 Aug. 27, 2015

(30) Foreign Application Priority Data

Feb. 25, 2014 (JP) ..... 2014-034456

(51) Int. Cl.
*G03G 15/00* (2006.01)

(52) U.S. Cl.
CPC ..... *G03G 15/50* (2013.01); *G03G 15/5058* (2013.01); *G03G 15/6582* (2013.01); *G03G 2215/00569* (2013.01); *G03G 2215/00877* (2013.01)

(58) Field of Classification Search
CPC ..... G03G 15/5058; G03G 15/50
USPC ..... 399/72, 82, 407
See application file for complete search history.

(56) References Cited

U.S. PATENT DOCUMENTS

2014/0005022 A1* 1/2014 Iida ..... 493/405
2014/0044468 A1* 2/2014 Nakamura ..... 399/407

FOREIGN PATENT DOCUMENTS

JP 2002012364 A 1/2002

OTHER PUBLICATIONS

Machine translation of JP 2002-012364 (publication date of Jan. 15, 2015) printed on Aug. 11, 2015.*

* cited by examiner

*Primary Examiner* — Sophia S Chen
(74) *Attorney, Agent, or Firm* — Canon USA, Inc. IP Division

(57) ABSTRACT

To convey a sheet to a sheet processing device among multiple sheet processing devices configured to perform different types of sheet processing on a sheet to be output, a printing apparatus includes an acquisition unit, a generation unit, and a printing unit. The acquisition unit acquires information from the multiple sheet processing devices to identify sheet processing. The generation unit generates an adjustment test image containing indications for adjusting respective sheet processing amounts from a shared reference line based on the information on each of the multiple sheet processing devices that is acquired by the acquisition unit. The printing unit prints the adjustment test image generated by the generation unit.

10 Claims, 23 Drawing Sheets

FIG.4

SHEET OUTPUT PROCESSING DEVICE
CONTROL INFORMATION MANAGEMENT TABLE

| ATTACHED SHEET OUTPUT PROCESSING DEVICE | SHEET OUTPUT PROCESSING FUNCTION | STATUS | POSITION ADJUSTMENT RANGE (mm) | REFERENCE POSITION | POSITION ADJUSTMENT SETTABILITY |
|---|---|---|---|---|---|
| FINISHER | FOLDING PROCESSING | NORMAL | ±8.5 | CENTER OF SHEET | SETTABLE |
| FINISHER | SADDLE STITCHING/ STAPLING PROCESSING | NORMAL | ±2 | CENTER OF SHEET | SETTABLE |
| TRIMMER | TRIMMING PROCESSING | NORMAL | 2−20 | EDGE OF SHEET | SETTABLE |
| CREASER | CREASING PROCESSING | NORMAL | ±20 | CENTER OF SHEET | SETTABLE |

FIG.10A

START POSITION ADJUSTMENT OF SHEET OUTPUT PROCESSING FUNCTION?

OK CANCEL

FIG.10B

PRINT "ADJUSTMENT IMAGE" FOR ADJUSTMENT OF FOLDING POSITION, SADDLE STITCHING/STAPLING POSITION, CREASING POSITION, AND TRIMMING POSITION?

YES NO

FIG.10C

SET ADJUSTMENT VALUE READ FROM ADJUSTMENT TEST IMAGE.

OK CANCEL

FIG.18

SHEET OUTPUT PROCESSING DEVICE
CONTROL INFORMATION MANAGEMENT TABLE

| ATTACHED SHEET OUTPUT PROCESSING DEVICE | SHEET OUTPUT PROCESSING FUNCTION | STATUS | POSITION ADJUSTMENT RANGE (mm) | REFERENCE POSITION | POSITION ADJUSTMENT SETTABILITY |
|---|---|---|---|---|---|
| FINISHER | FOLDING PROCESSING | NORMAL | ±8.5 | CENTER OF SHEET | SETTABLE |
| FINISHER | SADDLE STITCHING/ STAPLING PROCESSING | NORMAL | ±2 | CENTER OF SHEET | SETTABLE |
| TRIMMER | TRIMMING PROCESSING | NORMAL | 2−20 | EDGE OF SHEET | SETTABLE |
| CREASER | CREASING PROCESSING | NORMAL | ±20 | CENTER OF SHEET | NOT SETTABLE |

FIG.20

USE OPERATION UNIT OF CREASER TO SET CREASING POSITION ADJUSTMENT VALUE.

OK

PRINTING APPARATUS, METHOD OF CONTROLLING PRINTING APPARATUS, AND STORAGE MEDIUM

BACKGROUND OF THE INVENTION

1. Field of the Invention

The present invention relates to printing apparatuses, methods of controlling a printing apparatus, and storage media.

2. Description of the Related Art

There are techniques for adjusting each sheet processing position of a printing apparatus configured to cause sheet processing devices to execute multiple types of sheet processing.

For example, test printing for saddle stitch bookbinding is performed using an adjustment sheet (test chart) with scales for the folding in the middle and the trimming in sheet processing such as folding, saddle stitching, and trimming.

Then, the user checks the scale to measure the amounts of displacement between reference lines for the folding and the trimming and the result of the actual test printing, and then inputs the amounts of displacement so that the sheet processing positions can be adjusted with ease (refer to, for example, Japanese Patent Application Laid-Open No. 2002-012364).

However, according to the foregoing conventional technique, an image for the adjustment is a fixed image stored in advance in the printing apparatus. Thus, in a case where a sheet processing device having a new sheet output processing function (e.g., creasing) is connected, since there is no corresponding adjustment image, a test chart cannot be printed, and an image for the adjustment cannot be printed.

Furthermore, since the scale with the reference lines drawn from different reference positions for the respective types of sheet processing (folding in the middle, trimming) is used, the printing apparatus cannot handle a case where multiple sheet processing positions are to be set at the same reference position, e.g., folding in the middle and creasing.

SUMMARY OF THE INVENTION

According to an aspect of the present invention, a printing apparatus configured to convey a sheet to a sheet processing device among multiple sheet processing devices configured to perform different types of sheet processing on a sheet to be output includes an acquisition unit configured to acquire information from the multiple sheet processing devices to identify sheet processing, a generation unit configured to generate an adjustment test image containing indications for adjusting respective sheet processing amounts from a shared reference line based on the information on each of the multiple sheet processing devices that is acquired by the acquisition unit, and a printing unit configured to print the adjustment test image generated by the generation unit.

A system is provided to enable the user to make an indication for adjusting multiple sheet processing positions with respect to a shared reference line. Further features of the present invention will become apparent from the following description of exemplary embodiments with reference to the attached drawings.

BRIEF DESCRIPTION OF THE DRAWINGS

FIG. 4 illustrates an example of a management table.

FIGS. 10A, 10B, and 10C each illustrate an example of a user interface (UI) screen displayed on a printing apparatus.

FIG. 18 illustrates an example of a management table.

FIG. 20 illustrates an example of a UI screen displayed on a printing apparatus.

DESCRIPTION OF THE EMBODIMENTS

<Configuration of Image Forming Device>

Figure 1:
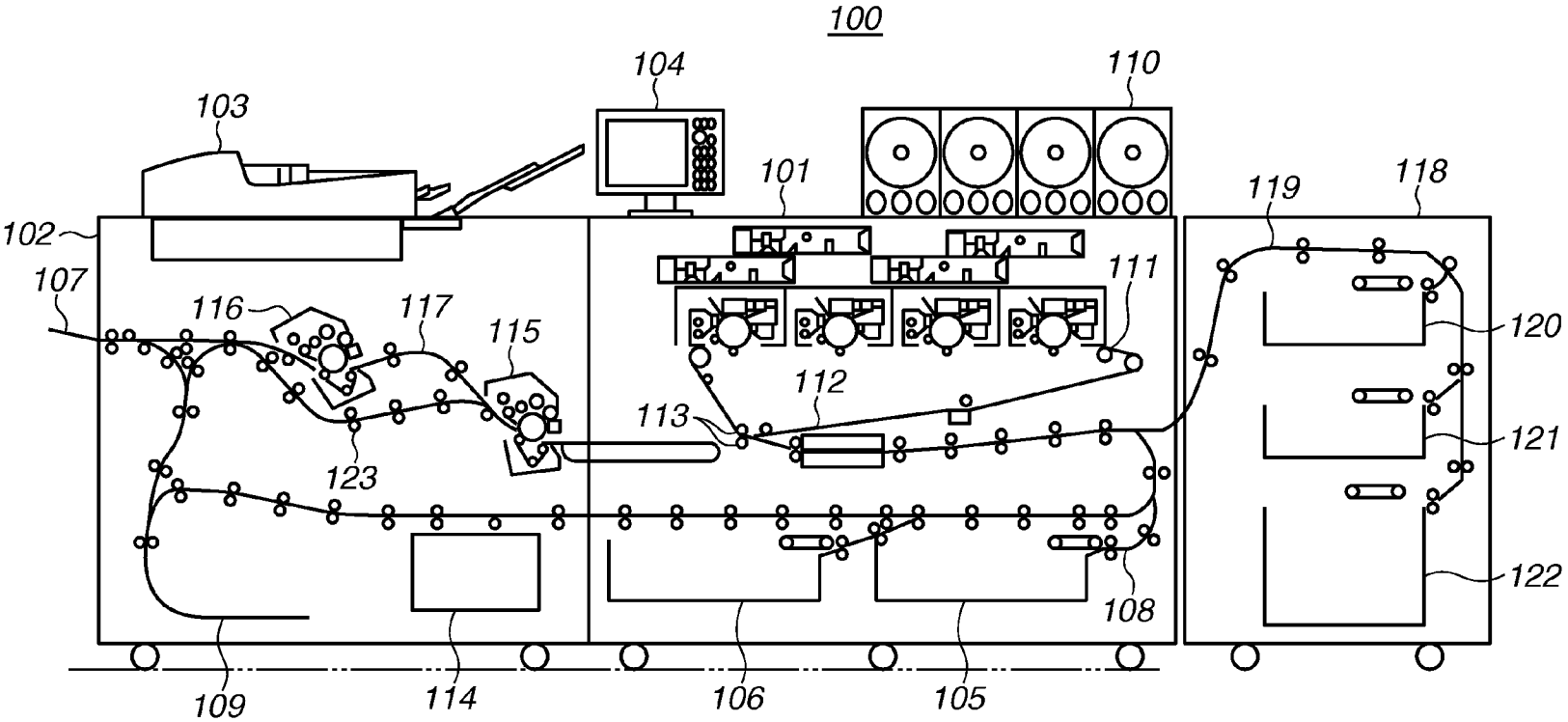
FIG. 1 is a cross sectional view illustrating an example of the configuration of a printing apparatus for which a sheet processing device can be employed.

The following describes a first exemplary embodiment. FIG. 1 is a cross sectional view illustrating an example of the configuration of a printing apparatus according to the present exemplary embodiment. In the present exemplary embodiment, an example in which sheet processing devices are connected to a printing apparatus 100 to execute sheet processing functions will be described.

The printing apparatus 100 includes an image forming unit 101, a fixing unit 102, a scanner unit 103, an operation unit 104, a sheet output unit 107, a toner supplying unit 110, and an external sheet feeding device 118. The image forming unit 101 includes sheet feeding devices 105 and 106, a sheet conveying unit 108, a primary transfer unit 111, a transfer belt 112, and a secondary transfer unit 113. The fixing unit 102 includes a switchbacking unit 109, a waste toner tank unit 114, fixing units 115 and 116, and sheet conveying units 117 and 123. The external sheet feeding device 118 includes a sheet conveying unit 119 and sheet feeding devices 120, 121, and 122.

The scanner unit 103 scans a document to generate electronic image data. The operation unit 104 receives various instructions given to the printing apparatus 100 by the operator. The operation unit 104 includes hardware keys as well as a display unit such as a touch panel display. The sheet feeding devices 105, 106, 120, 121, and 122 carry a sheet (recording material) to be printed by the printing apparatus 100. The sheet output unit 107 outputs a printed sheet to the outside of the printing apparatus 100.

Each sheet conveying unit includes rollers to convey sheets at regular intervals. The switchbacking unit 109 flips an output surface of a sheet when discharging the sheet to the sheet output unit 107. The toner supplying unit 110 supplies toner, which is a developer, to the image forming unit 101. The primary transfer unit 111 transfers a toner image formed according to image data onto the transfer belt 112. The second transfer unit 113 transfers a toner image transferred to the transfer belt 112 onto a sheet.

The waste toner tank unit 114 holds excess toner produced during a transfer process. The fixing unit 115 applies heat and pressure to a sheet onto which an image has been transferred by the secondary transfer unit 113, thereby fixing toner to the sheet. The fixing unit 116 applies heat and pressure to a sheet onto which an image has been fixed by the fixing unit 115, thereby further fixing the image. The sheet conveying units 108, 117, 119, and 123 are sheet conveying paths for conveying sheets. The sheet conveying unit 117 is a sheet conveying path for conveying a sheet from the fixing unit 115 to the fixing unit 116. The sheet conveying unit 123 is a sheet conveying path for conveying a sheet from the fixing unit 115 to the sheet output unit 107 or the switchbacking unit 109 to bypass the fixing unit 116. The sheet conveying units 108 and 119 are sheet conveying paths for supplying a sheet to the printing apparatus 100.

<Configuration of Sheet Processing Device>

Figure 2:
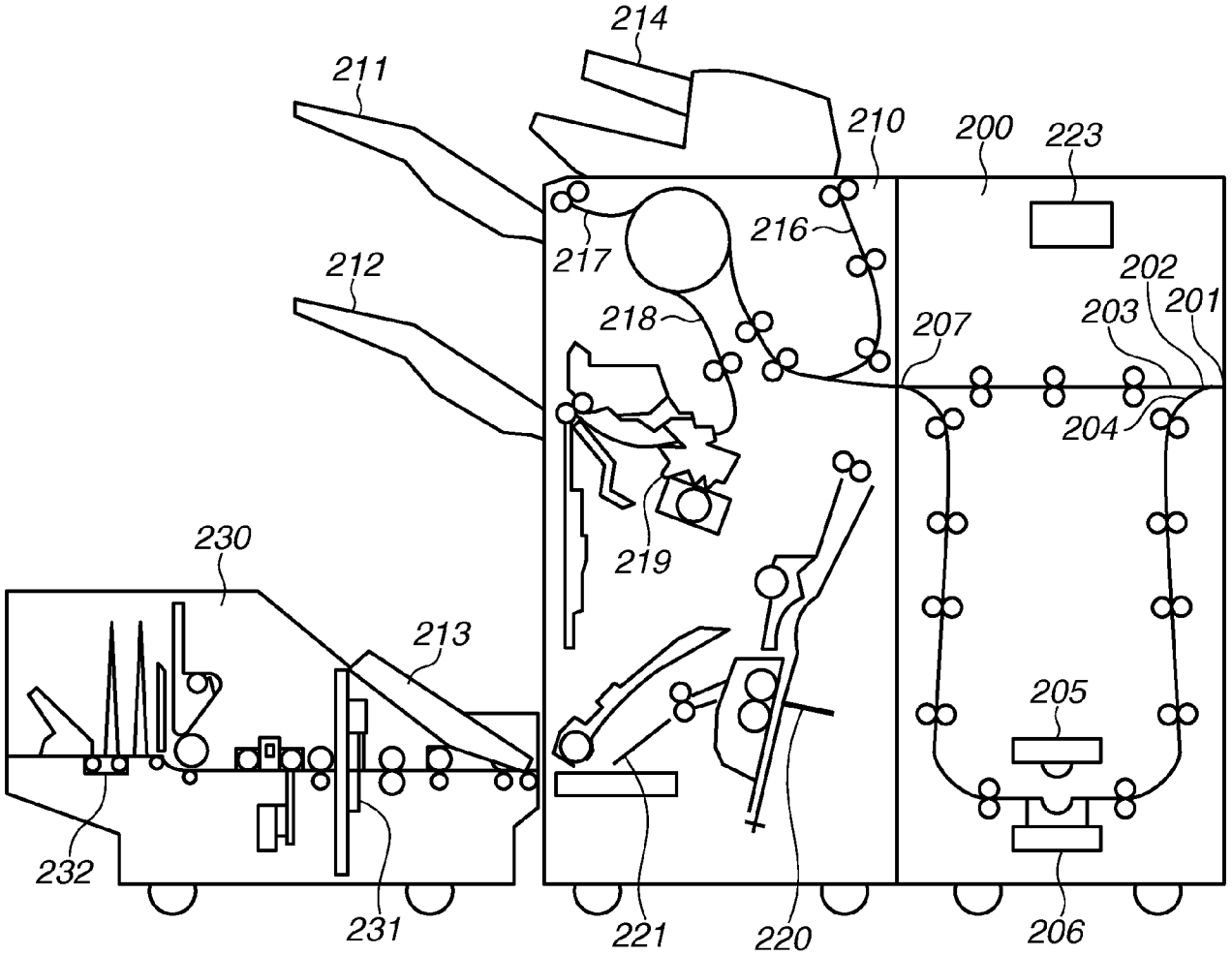
FIG. 2 is a cross sectional view illustrating sheet processing devices.

FIG. 2 is a cross sectional view illustrating sheet processing devices connected via the sheet output unit 107 of the printing apparatus 100 according to the present exemplary embodiment.

The connected sheet processing devices are a creaser 200, a finisher 210, and a trimmer 230, which will be described below.

The creaser 200 is a sheet output processing device (sheet processing device) configured to perform processing (creasing processing) to crease a sheet in advance along a predetermined position such as a folding position.

A sheet on which an image has been formed is input from the sheet output unit 107 of the printing apparatus 100 to a sheet input unit 201 of the creaser 200. In a case where execution of creasing is designated, a sheet is conveyed by sheet conveying paths 202 and 204 of the creaser 200 and then sandwiched between a protruded creasing die 205 and a depressed creasing die 206 so that the sheet is creased. The dies 205 and 206 may be changed according to the grammage or type of a sheet, and the user sets the most suitable dies each time. When the creasing is completed, the sheet is conveyed by the sheet conveying path 207 and then output to a subsequent sheet processing device. On the other hand, in a case where execution of creasing is not designated, a sheet is conveyed by the sheet conveying paths 202 and 203 and then output to the sheet conveying path 207.

In a case where the sheet is to be conveyed to a subsequent sheet processing device of the creaser 200, the sheet is conveyed by the sheet conveying path 207 to the finisher 210.

An operation unit 223 receives various instructions given to the creaser 200 by the operator. The operation unit 223 includes hardware keys as well as a display unit.

The following describes the finisher 210. The finisher 210 performs post processing on a printed sheet according to a function designated by the user. Specifically, the finisher 210 has functions such as stapling (single, double), punching (two holes, three holes), and saddle-stitch bookbinding. The finisher 210 includes two sheet output trays in total, sheet output trays 211 and 212. A sheet is conveyed by the sheet conveying path 217 and then output to the sheet output tray 211.

The stapling processing and the like cannot be performed on the sheet conveying path 217. In a case where the stapling processing or the like is to be performed, a sheet is conveyed to a processing unit 219 by the sheet conveying path 218, and the processing unit 219 executes a finishing function, which is a function designated by the user, on the sheet and outputs the sheet to the sheet output tray 212.

The sheet output trays 211 and 212 can be moved up and down. The finisher 210 may be operated such that the sheet output tray 211 is moved down and a sheet having undergone the finishing processing performed by the processing unit 219 is output from a lower exit slot and then stacked on the sheet output tray 211.

In a case where the user designates an insertion sheet, the finisher 210 may be operated such that an insertion sheet set in an inserter 214 is conveyed by the sheet conveying path 216 and then inserted between predetermined pages. In a case where the saddle-stitch bookbinding is designated, sheets are stapled in the center and thereafter folded in half by a saddle-stitch processing unit 220, conveyed by a sheet conveying path 221, and then output to a saddle-stitched booklet tray 213. The saddle-stitched booklet tray 213 has a conveyor belt structure, and saddle-stitched booklets stacked on the saddle-stitched booklet tray 213 are conveyed leftward.

The following describes the trimmer 230.

The trimmer 230 is a sheet output processing device (sheet processing device) configured to perform trimming processing (trimming) on saddle-stitched booklets. In a case where an instruction to perform trimming is received, saddle-stitched booklets are conveyed by the sheet conveying path 221 to the trimmer 230. Thereafter, the saddle-stitched booklets are trimmed by a cutter unit 231 and then output to a trimmed saddle-stitched booklet tray 232.

<Control Configuration of Printing Apparatus 100>

Figure 3:
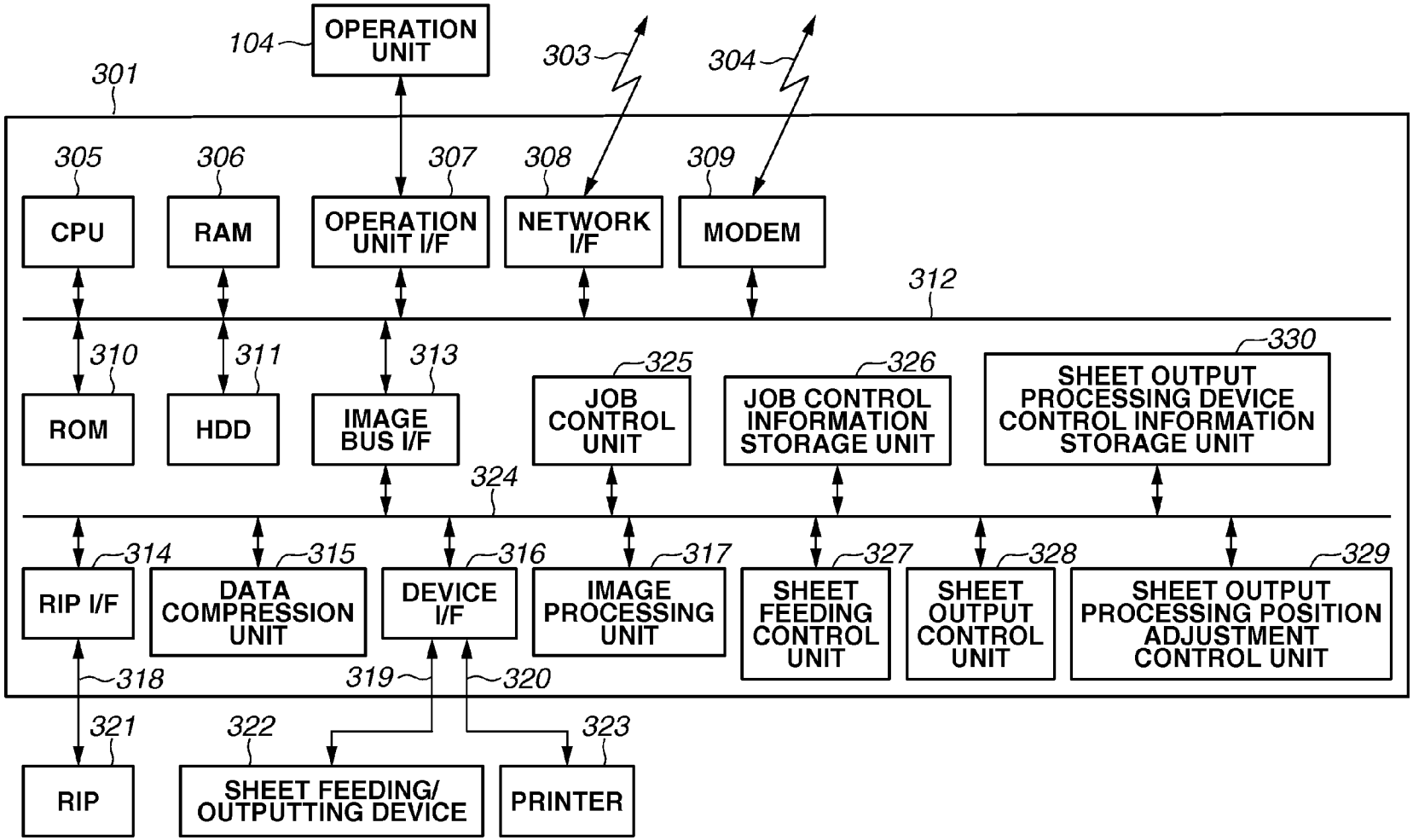
FIG. 3 is a block diagram illustrating a main controller of a printing apparatus.

FIG. 3 is a block diagram illustrating a main controller 301 of the printing apparatus 100 according to the present exemplary embodiment.

The main controller 301 includes a central processing unit (CPU) 305, a random-access memory (RAM) 306, an operation unit interface (I/F) 307, a network I/F unit 308, a modem 309, a read-only memory (ROM) 310, and a hard disk drive (HDD) 311. The main controller 301 further includes via an image bus I/F 313 a raster image processor (RIP) I/F 314, a data compression unit 315, a device I/F 316, and an image processing unit 317. The main controller 301 also includes a CPU bus 312 and an image bus 324.

A network cable 303 for connecting to an external device by a network is connected to the network I/F 308. A line cable 304 for connecting to an external device by a telephone line is connected to the modem 309.

The CPU 305 runs a program for controlling the entire main controller 301. The RAM 306 is managed by a program running on the CPU 305. The RAM 306 is used as a receiving buffer for temporarily storing data received from an external device, an image data buffer for temporarily storing image data rasterized by a RIP 321, etc.

The ROM 310 stores a program to run on the CPU 305, data, etc. The HDD 311 is a nonvolatile storage device capable of storing various types of data for a long time.

The operation unit I/F 307 is an interface for connecting the operation unit 104 and the main controller 301 together. The image bus I/F 313 is an interface for connecting the CPU bus 312 and the image bus 324 together. The RIP 321 is connected to the RIP I/F 314 via a data bus 318.

The RIP 321 is a rasterizing board (RIP) having a function of converting image description data input from an external device into bitmap image data. The RIP I/F 314 is an interface for connecting the RIP 321 and the image bus 324 together with the data bus 318. The data compression unit 315 compresses data.

A sheet feeding/outputting device 322 is connected to the device I/F 316 via a data bus 319. A printer 323 is connected to the device I/F 316 via a data bus 320. The configuration of the printer 323 is as described above with reference to FIG. 1.

The CPU 305 issues a command for printing to the sheet feeding/outputting device 322 and the printer 323 via the data bus 319 and 320, respectively, according to an instruction signal from the operation unit 104 or an external device via the network cable 303.

A command for giving an instruction to perform sheet output processing (sheet processing) such as creasing, folding, saddle stitching/stapling, and trimming to a control device included in the sheet feeding/outputting device 322 is also issued and associated with a sheet to be printed.

The image processing unit 317 performs various types of image processing on bitmap image data generated by the RIP 321. The image processing unit 317 has a function of digitally processing bitmap image data, such as a function of combining 2-page bitmap image data into 1-page bitmap image data.

A job control unit 325 analyzes data received from an external device as a job to acquire control information such as the number of copies (N), sheet feeding designation, sheet output processing information (creasing, folding, saddle stitching/stapling, trimming, etc.), and the like and controls the data as a job. A job control information storage unit 326 is an area where the acquired control information is stored.

A sheet feeding control unit 327 manages the sheet feeding control together with the CPU 305 and the job control unit 325. A sheet output control unit 328 manages, together with the CPU 305 and the job control unit 325, the sheet control relating to the sheet output including the sheet output processing functions such as folding, binding, creasing, and trimming using the creaser 200, the finisher 210, and the trimmer 230.

A sheet output processing position adjustment control unit 329 controls the functional processing to adjust the positions in which the sheet output functions of the sheet processing devices (creaser 200, finisher 210, trimmer 230) are to be executed on a sheet. A sheet output processing device control information storage unit 330 is an area where information on the sheet output processing devices that are attached is stored.

FIG. 4 illustrates an example of a sheet output processing device control information management table (hereinafter, referred to as "management table") stored in the sheet output processing device control information storage unit 330 illustrated in FIG. 3. The management table manages the sheet processing devices of the sheet output unit 107, the sheet output processing functions of the sheet processing devices, the statuses of the sheet output processing functions, information on the position adjustment ranges of the sheet output processing functions, sheet reference positions for the position adjustment, the position adjustment settability by the printing apparatus 100, etc.

Figures 5, 5A:
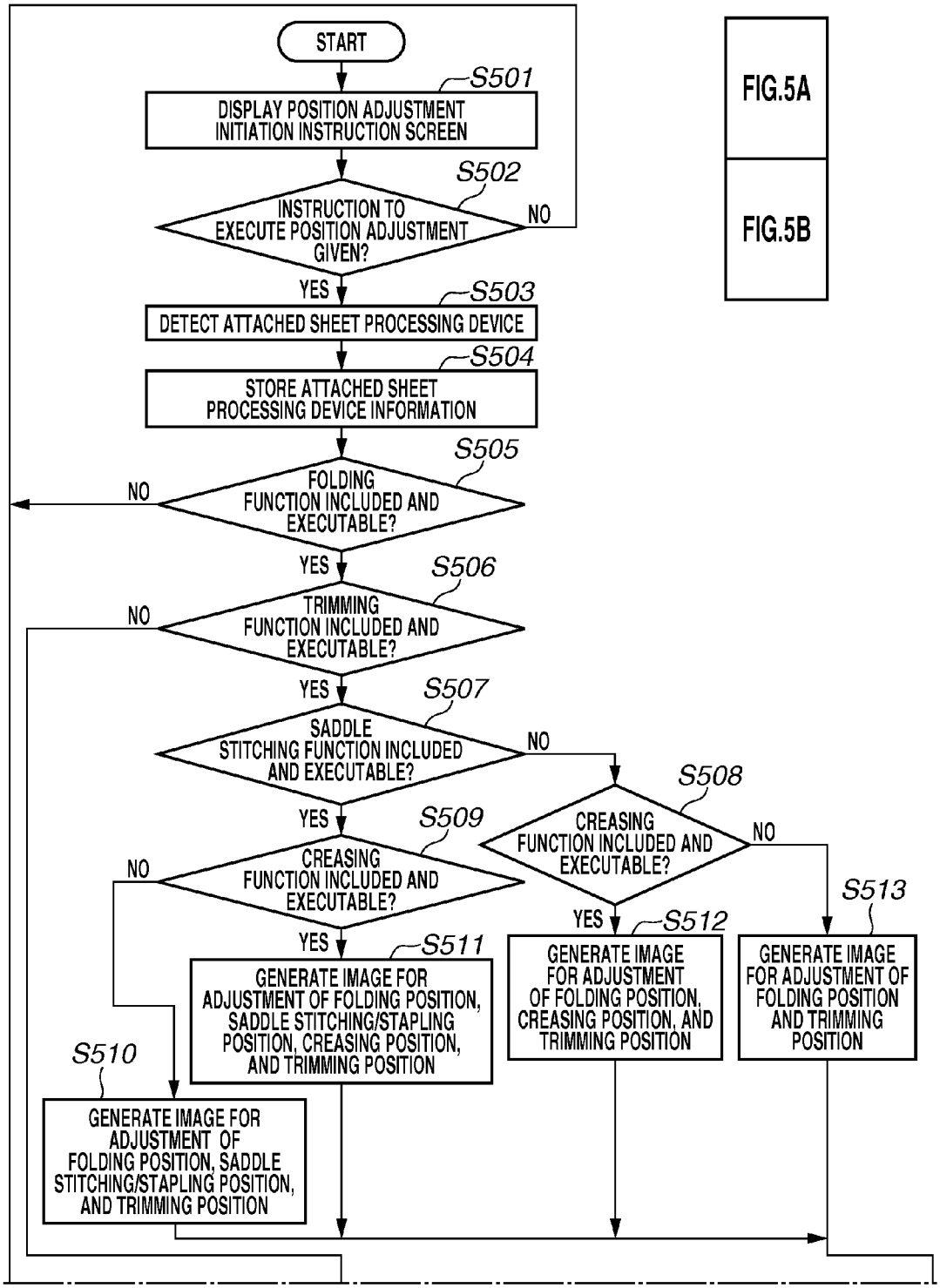
FIG. 5, which includes
FIG. 5A and FIG. 5B, is a flow chart illustrating a method of controlling a printing apparatus.

FIG. 5 is a flow chart illustrating a method of controlling the printing apparatus according to the present exemplary embodiment. The CPU 305 executes a stored control program to realize each of the steps.

In step S501, the CPU 305 instructs the operation unit 104 via the operation unit I/F 307 to display a screen (FIG. 10A) for giving an instruction on whether to execute the position adjustment of the sheet output processing function. Then, in step S502, the CPU 305 determines whether an instruction to execute the position adjustment is given. If the CPU 305 determines that an instruction to execute the position adjustment is not given (NO in step S502), the processing ends.

On the other hand, if the CPU 305 determines that an instruction to execute the position adjustment is given (YES in step S502), the processing proceeds to step S503, and the CPU 305 detects the sheet processing devices that are currently attached and the sheet output processing functions of the attached sheet processing devices and acquires related information under the control by the sheet output control unit 328 and the sheet output processing position adjustment control unit 329.

Information to be acquired in step S503 includes the sheet processing devices that are connected, the sheet output processing functions of the sheet processing devices, the statuses of the sheet output processing functions, information on the position adjustment ranges of the sheet output processing functions, sheet reference positions for the position adjustment, and the position adjustment settability by the printing apparatus 100.

Next, in step S504, the CPU 305 associates the detected sheet processing devices, the detected sheet output processing functions, and related information with the items specified in FIG. 4 and stores them in the management table (FIG. 4). Then, based on the information stored in the management table, the CPU 305 generates an adjustment sheet image for the position adjustment of a sheet output processing function that corresponds to an executable sheet output processing function detected in subsequent processing. The following describes the processing using the management table illustrated in FIG. 4 as an example.

In step S505, the CPU 305 determines whether the folding function is included and executable based on the contents of the management table (FIG. 4) under the control by the sheet output processing position adjustment control unit 329.

If the CPU 305 determines that the folding function processing is executable (YES in step S505), then in step S506, the CPU 305 determines whether the trimming function is included and executable based on the contents of the management table (FIG. 4) under the control by the sheet output processing position adjustment control unit 329.

If the CPU 305 determines that the trimming function processing is executable (YES in step S506), then in step S507, the CPU 305 determines whether the saddle stitching function is included and executable based on the contents of the management table (FIG. 4) under the control by the sheet output processing position adjustment control unit 329.

If the CPU 305 determines that the saddle stitching processing is executable (YES in step S507), then in step S509, the CPU 305 determines whether the creasing function is included and executable based on the contents of the management table (FIG. 4) under the control by the sheet output processing position adjustment control unit 329.

If the CPU 305 determines that the creasing processing is executable (YES in step S509), the processing proceeds to step S511. Then, based on the sheet output processing position adjustment control unit 329, the image processing unit 317, and the information stored in the management table (FIG. 4), the CPU 305 generates a dedicated adjustment sheet image for the adjustment of the folding position, the saddle stitching/stapling position, the creasing position, and the trimming position.

Figure 6A:
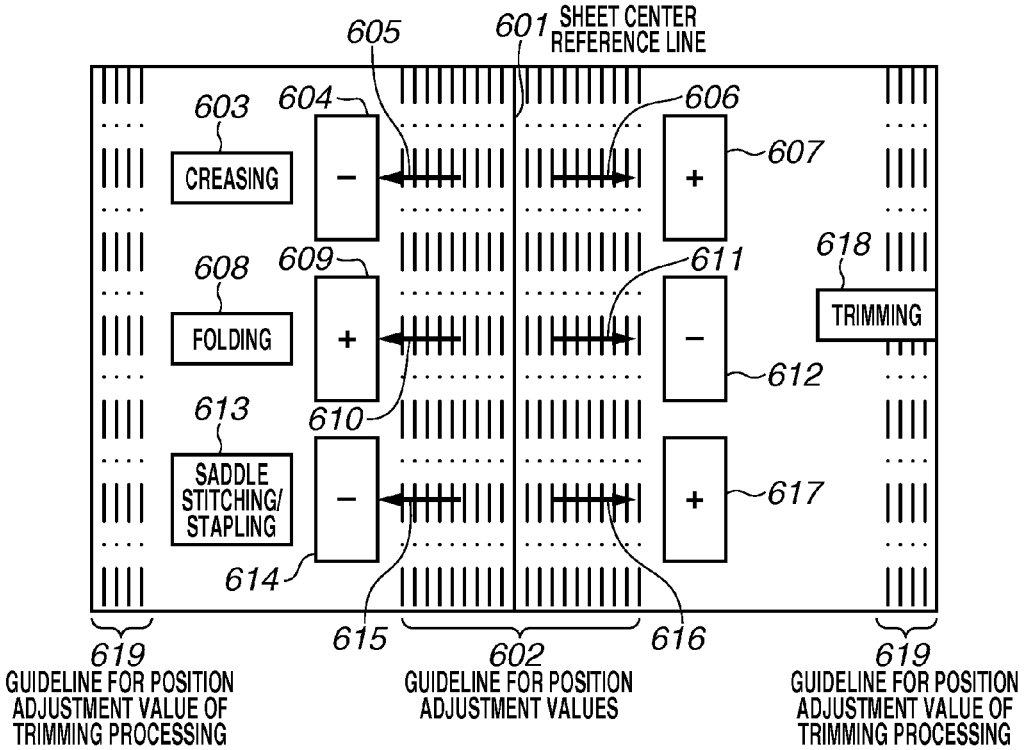
FIGS. 6A and 6B each illustrate an example of an adjustment sheet image.

FIG. 6A illustrates an example of a dedicated adjustment sheet image (adjustment test image) generated in step S511 for the adjustment of the folding position, the saddle stitching/stapling position, the creasing position, and the trimming position. This is an example in which an image containing indications showing the increase/decrease of an adjustment value of each sheet processing device and indications showing the direction of increase/decrease is generated. Indications for adjusting the trimming are generated such that indications for adjusting the amount of the sheet processing from a shared reference line are printed on outer edges of the sheet.

In FIG. 6A, a sheet center reference line 601 is a reference for the adjustment of the folding position, the saddle stitching/stapling position, and the creasing position.

Guidelines 602 for reading a position adjustment value are spaced 1 mm apart. The number of guidelines 602 corresponds to the position adjustment ranges of the folding processing, the saddle stitching/stapling processing, and the creasing processing that are stored in the management table (FIG. 4), with the sheet center reference line (601) being the center.

Sections 603, 608, 613, and 618 respectively indicate the sheet output processing functions that the adjustment values are for.

Sections 604, 607, 609, 612, 614, and 617 each indicate a plus (+) or minus (−), each of which indicates the direction of the guideline adjustment value. Arrows 605, 606, 610, 611, 615, and 616 each explicitly indicate the plus/minus direction of the guideline adjustment value.

Guidelines 619 for reading a position adjustment value of the trimming processing are spaced 1 mm apart. The number of guidelines 619 corresponds to the position adjustment ranges of the folding processing and the trimming processing that are stored in the management table (FIG. 4), with a sheet edge being a reference.

Then, in step S521, the CPU 305 instructs the operation unit 104 via the operation unit I/F 307 to display a screen for selecting whether to execute the adjustment test image printing in which the sheet output processing functions are performed using as an adjustment sheet image the image for the position adjustment of the sheet output processing functions that are determined as being executable this time. An example of the screen is illustrated in FIG. 10B. In the present control example, the sheet output processing functions are the folding processing, the saddle stitching processing, the creasing processing, and the trimming processing.

Then, in step S522, the CPU 305 determines whether an instruction to execute the adjustment test image printing is given. If the CPU 305 determines that an instruction to execute the adjustment test image printing is not given (NO in step S522), the processing ends. On the other hand, if the CPU 305 determines that an instruction to execute the adjustment test image printing is given (YES in step S522), the processing proceeds to step S523.

The CPU 305 executes the adjustment test image printing in which the folding processing, the saddle stitching/stapling processing, the creasing processing, and the trimming processing are performed using the generated adjustment sheet image (FIG. 6A) under the control by the job control unit 325, the sheet output control unit 328, and the image processing unit 317.

Next, in step S524, the CPU 305 displays on the operation unit 104 via the operation unit I/F 307 a screen (FIG. 10C) for selecting whether to set an adjustment value from the printed adjustment test image. Then, in step S525, the CPU 305 determines whether an instruction to set a position adjustment value is given. If the CPU 305 determines that an instruction to set a position adjustment value is not given (NO in step S525), the processing ends.

On the other hand, if the CPU 305 determines that an instruction to set a position adjustment value is given (YES in step S525), the processing proceeds to step S526, and the CPU 305 refers to the management table (FIG. 4) and displays on the operation unit 104 a screen for collectively inputting the adjustment values of the sheet output processing functions that have the same reference position. The management table is stored in the sheet output processing device control information storage unit 330.

Figure 11A:
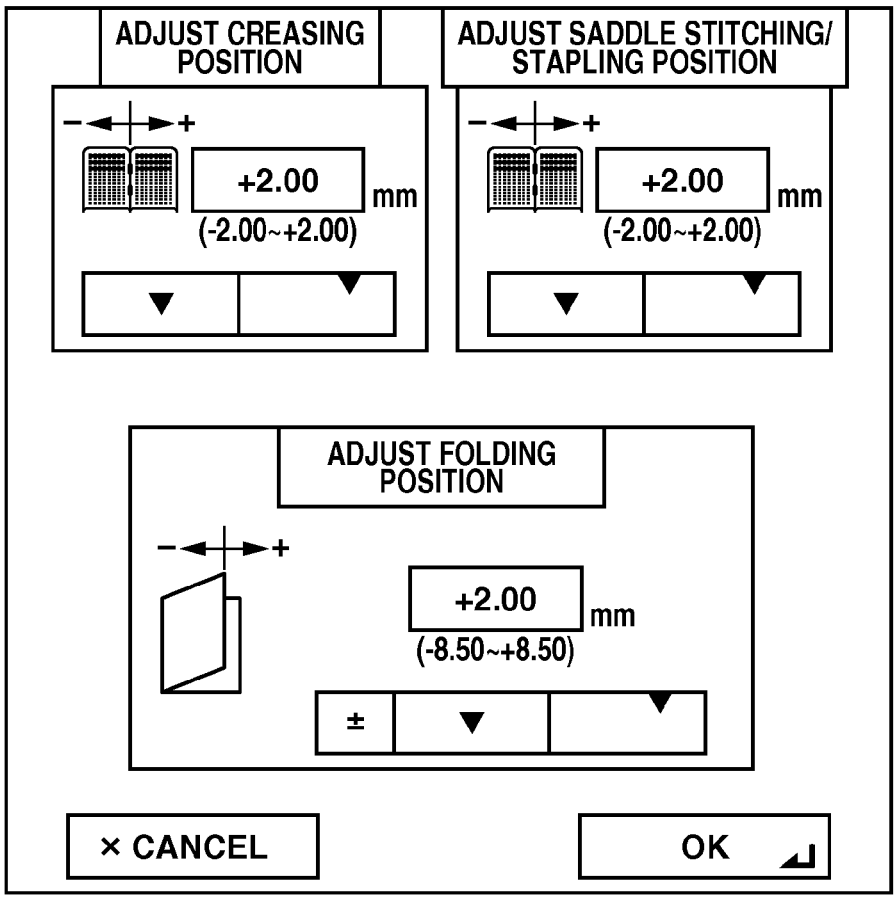
FIGS. 11A and 11B each illustrate an example of a UI screen displayed on a printing apparatus.

In the present control example, a screen (FIG. 11A) that collectively displays the settings of the folding processing, the saddle stitching/stapling processing, and the creasing processing, all of which have the same sheet center reference, is displayed.

In step S527, the CPU 305 determines whether the input of the position adjustment values from the operation unit 104 via the operation unit I/F 307 is completed. If the CPU 305 determines that no position adjustment value is input (NO in step S527), the processing ends.

On the other hand, if the CPU 305 determines that the input of the position adjustment values is completed (YES in step S527), then in step S528, the CPU 305 sets the input adjustment values to the corresponding sheet processing devices connected to the printing apparatus 100 under the control by the sheet output control unit 328 and the sheet output processing position adjustment control unit 329. In the present control example, the position adjustment values of the folding processing and the saddle stitching/stapling processing are set to the finisher 210, and the position adjustment value of the creasing processing is set to the creaser 200.

Next, in step S529, the CPU 305 determines from the management table (FIG. 4) stored in the sheet output processing device control information storage unit 330 whether there is a sheet output processing functions with a different reference position of the position adjustment from the reference position in step S526 under the control by the sheet output processing position adjustment control unit 329. If the CPU 305 determines that there is no sheet output processing functions with a different reference position (NO in step S529), the processing ends.

On the other hand, if the CPU 305 determines that there is a sheet output processing functions with a different reference position (YES in step S529), the processing proceeds to step S530, and the CPU 305 displays on the operation unit 104 via the operation unit I/F 307 a screen for inputting the adjustment value of the sheet output processing function having a different reference position of the position adjustment from the management table (FIG. 4).

Figure 11B:
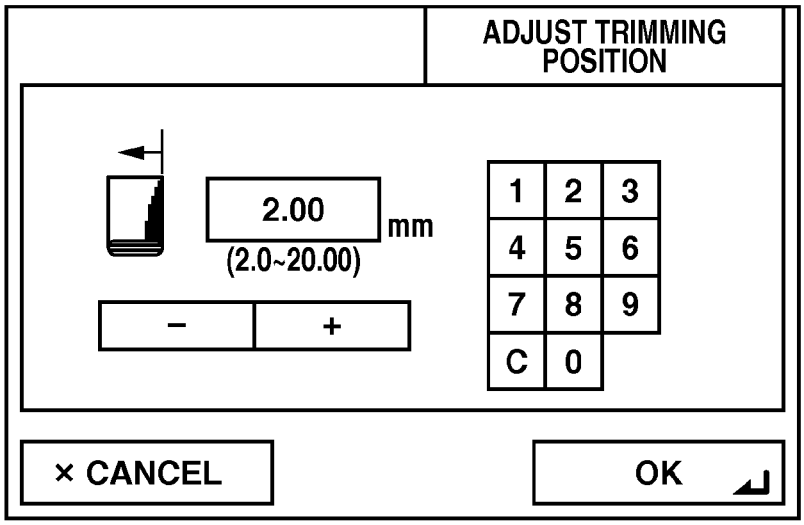

In the present control example, the trimming processing with the sheet edge reference is the sheet output processing function having a different reference position, and the screen illustrated in FIG. 11B is displayed.

In step S531, the CPU 305 determines whether the input of the adjustment values from the operation unit 104 via the operation unit I/F 307 is completed. If the CPU 305 determines that no position adjustment value is input (NO in step S531), the processing ends.

On the other hand, in step S531, if the CPU 305 determines that the input of the position adjustment values is completed (YES in step S531), then in step S532, the CPU 305 sets the input adjustment values to the corresponding sheet processing devices under the control by the sheet output control unit 328 and the sheet output processing position adjustment control unit 329. The input adjustment values are input via the device I/F 316. In the present control example, the position adjustment value of the trimming processing is set to the trimmer 230.

On the other hand, in step S509, if the CPU 305 determines that the creasing function is not executable (NO in step S509), the processing proceeds to step S510.

Then, in step S510, the CPU 305 generates a dedicated adjustment sheet image for the adjustment of the folding position, the saddle stitching position, and the trimming position based on the sheet output processing position adjustment control unit 329, the image processing unit 317, and the information stored in the management table (FIG. 4).

Figure 7A:
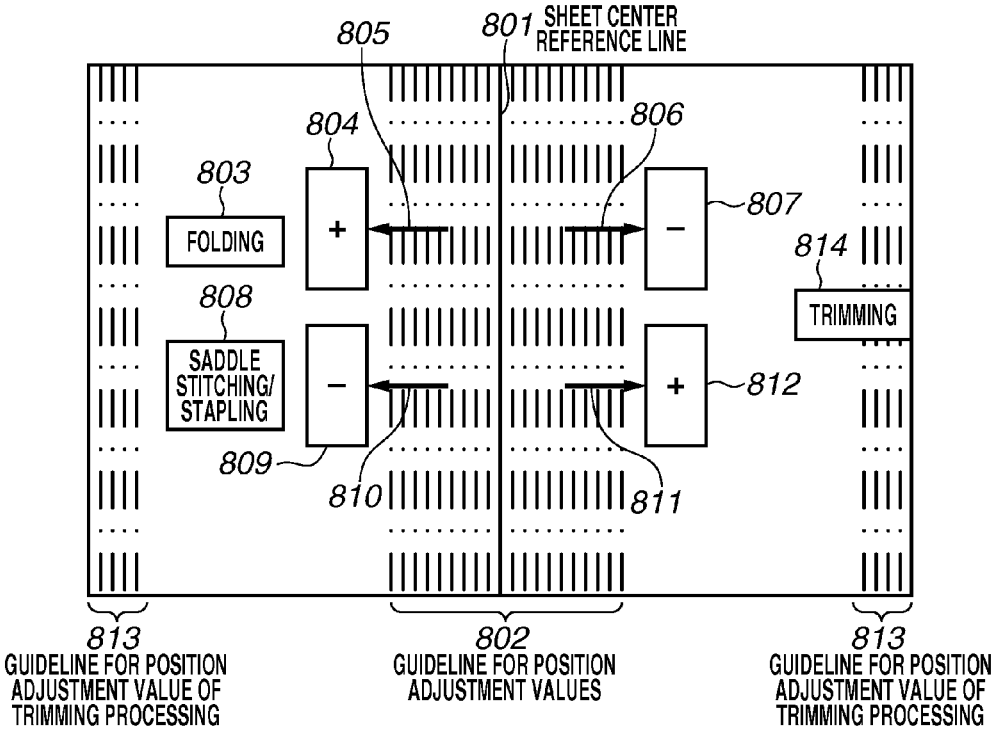
FIGS. 7A and 7B each illustrate an example of an adjustment sheet image.
Figure 7B:
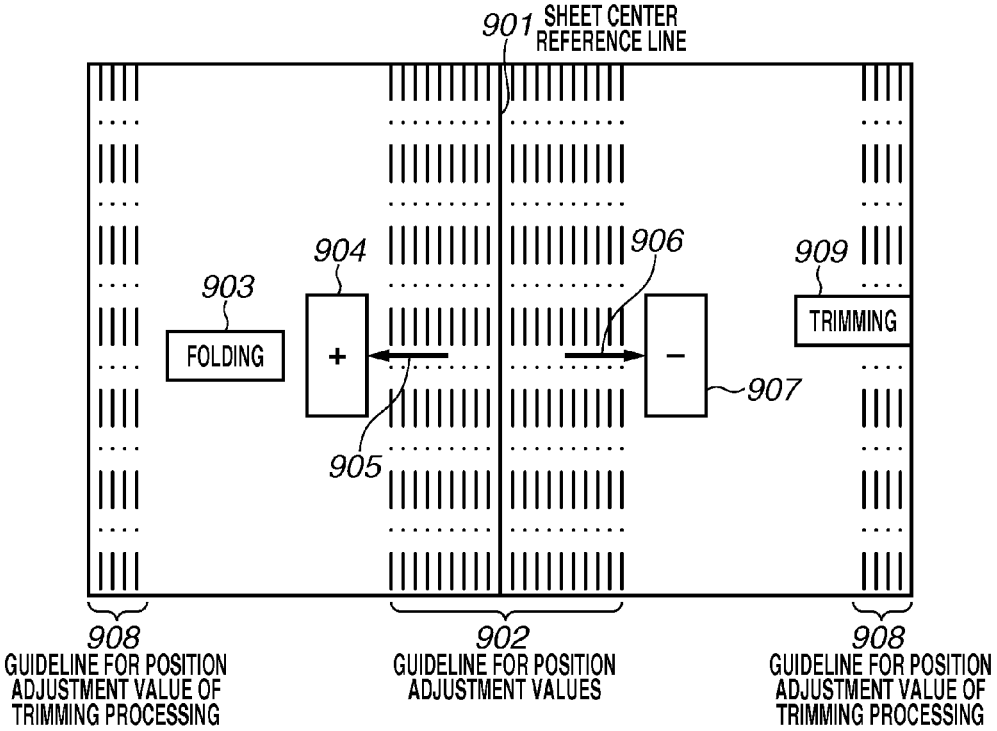

FIGS. 7A and 7B each illustrate an example of an adjustment sheet image suitable for the sheet processing devices according to the present exemplary embodiment. Especially, FIG. 7A illustrates an example of a dedicated adjustment sheet image generated in step S510 for the adjustment of the folding position, the saddle stitching/stapling position, and the trimming position.

In FIG. 7A, a sheet center reference line 801 is a reference for the adjustment of the folding position and the saddle stitching position.

Guidelines 802 for reading a position adjustment value are spaced 1 mm apart. The number of guidelines 802 corresponds to the adjustment ranges of the folding position and the saddle stitching/stapling position that are stored in the management table (FIG. 4), with the sheet center reference line (801) being the center. Sections 803, 808, and 814 respectively indicate the sheet output processing functions that the adjustment values are for.

Sections 804, 807, 809, and 812 each indicate a plus (+) or minus (−), each of which indicates the direction of the guideline adjustment value. Arrows 805, 806, 810, and 811 each explicitly indicate the plus/minus direction of the guideline adjustment value.

Guidelines 813 for reading a position adjustment value of the trimming processing are spaced 1 mm apart. The number of guidelines 813 corresponds to the adjustment ranges of the folding position and the trimming position that are stored in the management table (FIG. 4), with a sheet edge being a reference. Then, the processing proceeds to step S521, and the subsequent processing is performed as described above.

On the other hand, in step S507, if the CPU 305 determines that the saddle stitching function is not executable (NO in step S507), the processing proceeds to step S508, and the CPU 305 determines whether the creasing function is executable. If the CPU 305 determines that the creasing function is not executable (NO in step S508), the processing proceeds to step S513.

Then, in step S513, the CPU 305 generates a dedicated adjustment sheet image for the adjustment of the folding position and the trimming position based on the sheet output processing position adjustment control unit 329, the image processing unit 317, and the information stored in the management table (FIG. 4).

FIG. 7B illustrates an example of a dedicated adjustment sheet image generated in step S513 for the adjustment of the folding position and the trimming position.

In FIG. 7B, a sheet center reference line 901 is a reference for the adjustment of the folding position. Guidelines 902 for reading a position adjustment value are spaced 1 mm apart. The number of guidelines 902 corresponds to the position adjustment range of the folding processing that is stored in the management table (FIG. 4), with the sheet center reference line (901) being the center. Sections 903 and 909 respectively indicate the sheet output processing functions that the adjustment values are for. Sections 904 and 907 each indicate a plus (+) or minus (−), each of which indicates the direction of the guideline adjustment value. Arrows 905 and 906 each explicitly indicate the plus/minus direction of the guideline adjustment value.

Guidelines 908 for reading a position adjustment value for the adjustment of the trimming position are spaced 1 mm apart. The number of guidelines 908 corresponds to the position adjustment ranges of the folding processing and the trimming processing that are stored in the management table (FIG. 4), with a sheet edge being a reference. Then, the processing proceeds to step S521, and the subsequent processing is performed as described above.

In step S508, the CPU 305 determines whether the creasing function is executable. If the CPU 305 determines that the creasing function is executable (YES in step S508), the processing proceeds to step S512.

In step S512, the CPU 305 generates a dedicated adjustment sheet image for the adjustment of the folding position, the creasing position, and the trimming position based on the sheet output processing position adjustment control unit 329, the image processing unit 317, and the information stored in the management table (FIG. 4).

Figure 6B:
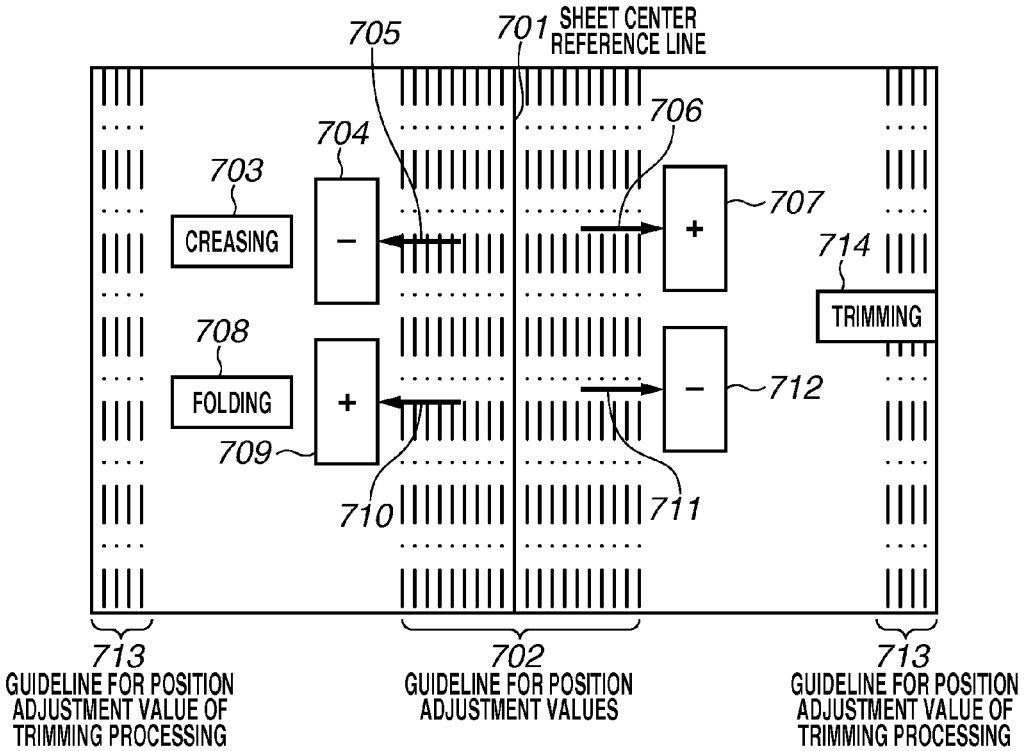

FIG. 6B illustrates an example of a dedicated adjustment sheet image generated in step S512 for the adjustment of the folding position, the creasing position, and the trimming position.

In FIG. 6B, a sheet center reference line 701 is a reference for the adjustment of the folding position and the creasing position. Guidelines 702 for reading a position adjustment value are spaced 1 mm apart. The number of guidelines 702 corresponds to the position adjustment range of the folding processing that is stored in the management table (FIG. 4), with the sheet center reference line (701) being the center. Sections 703, 708, and 714 respectively indicate the sheet output processing functions that the adjustment values are for. Sections 704, 707, 709, and 712 each indicate a plus (+) or minus (−), each of which indicates the direction of the guideline adjustment value. Arrows 705, 706, 708, and 711 each explicitly indicate the plus/minus direction of the guideline adjustment value.

Guidelines 713 for reading a position adjustment value of the trimming processing are spaced 1 mm apart. The number of guidelines 713 corresponds to the position adjustment ranges of the folding processing and the trimming processing that are stored in the management table (FIG. 4), with a sheet edge being a reference. Then, the processing proceeds to step S521, and the subsequent processing is performed as described above.

On the other hand, in step S506, if the CPU 305 determines that the trimming processing function is not executable (NO in step S506), the processing proceeds to step S514. In step S514, the CPU 305 determines from the management table (FIG. 4) whether the saddle stitching function is included and executable under the control by the sheet output processing position adjustment control unit 329.

If the CPU 305 determines that the saddle stitching is executable (YES in step S514), then in step S516, the CPU 305 determines from the management table (FIG. 4) whether the creasing function is included and executable under the control by the sheet output processing position adjustment control unit 329. If the CPU 305 determines that the creasing is executable (YES in step S516), the processing proceeds to step S518.

Then, in step S518, the CPU 305 generates a dedicated adjustment sheet image for the adjustment of the folding position, the saddle stitching/stapling position, and the creasing position based on the sheet output processing position adjustment control unit 329, the image processing unit 317, and the information stored in the management table (FIG. 4).

Figure 8A:
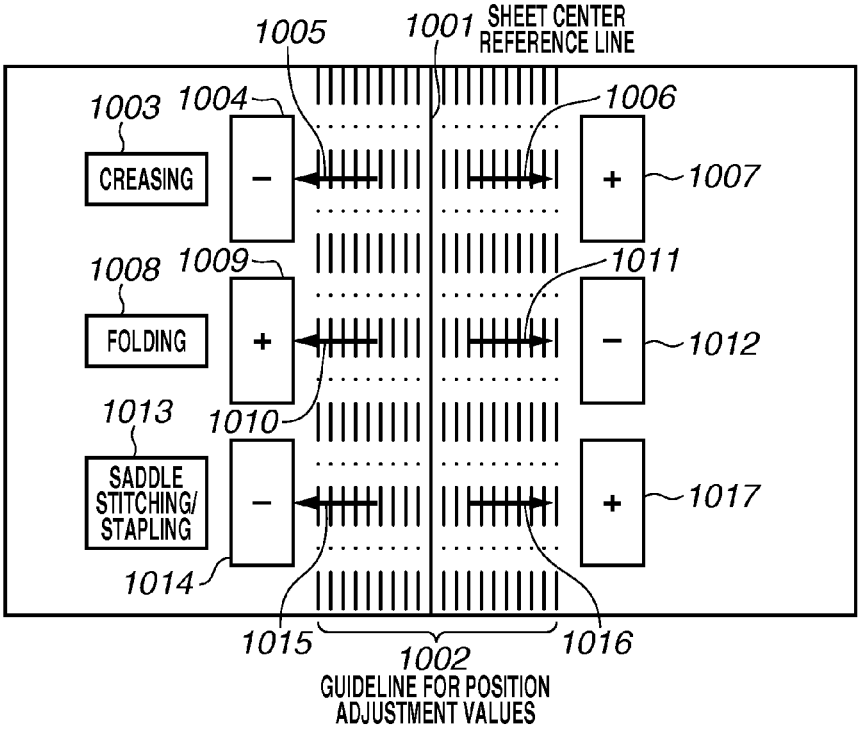
FIGS. 8A and 8B each illustrate an example of an adjustment sheet image.
Figure 8B:
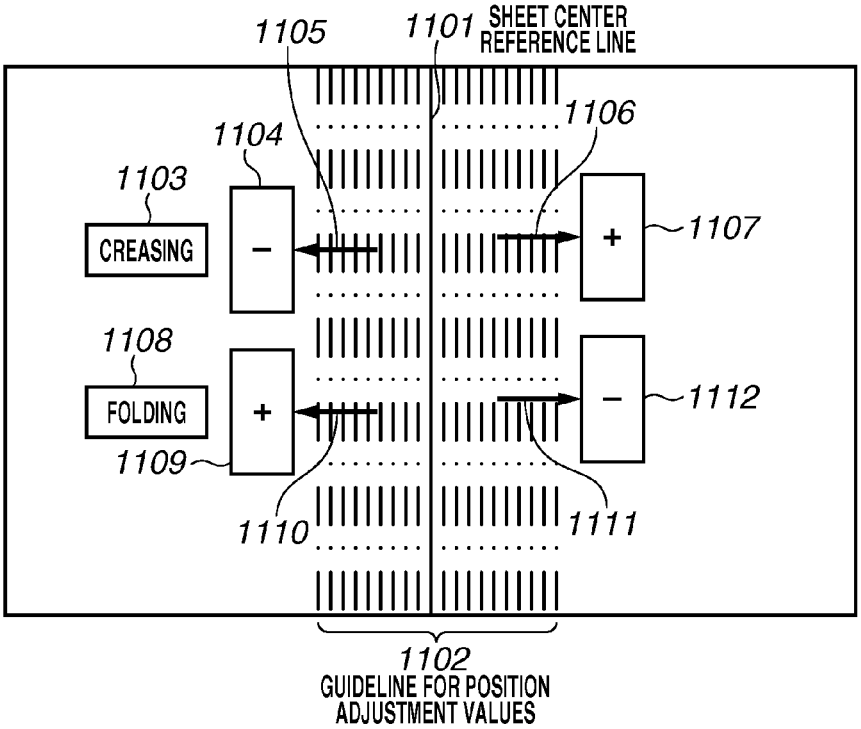

FIGS. 8A and 8B each illustrate an example of an adjustment sheet image suitable for the sheet processing devices according to the present exemplary embodiment. Especially, FIG. 8A illustrates an example of a dedicated adjustment sheet image generated in step S518 for the adjustment of the folding position, the saddle stitching/stapling position, and the creasing position.

In FIG. 8A, a sheet center reference line 1001 is a reference for the adjustment of the folding position, the saddle stitching/stapling position, and the creasing position.

Guidelines 1002 for reading a position adjustment value are spaced 1 mm apart. The number of guidelines 1002 corresponds to the adjustment ranges of the folding position, the saddle stitching/stapling position, and the creasing position that are stored in the management table (FIG. 4), with the sheet center reference line (1001) being the center. Sections 1003, 1008, and 1013 respectively indicate the sheet output processing functions that the adjustment values are for. Sections 1004, 1007, 1009, 1012, 1014, and 1017 each indicate a plus (+) or minus (−), each of which indicates the direction of the guideline adjustment value. Arrows 1005, 1006, 1010, 1011, 1015, and 1016 each explicitly indicate the plus/minus direction of the guideline adjustment value. Then, the processing proceeds to step S521, and the subsequent processing is performed as described above.

On the other hand, in step S516, if the CPU 305 determines that the creasing function is not executable (NO in step S516), the processing proceeds to step S517. In step S517, the CPU 305 generates a dedicated adjustment sheet image for the adjustment of the folding position and the saddle stitching/stapling position based on the sheet output processing position adjustment control unit 329, the image processing unit 317, and the information stored in the management table (FIG. 4).

Figure 9A:
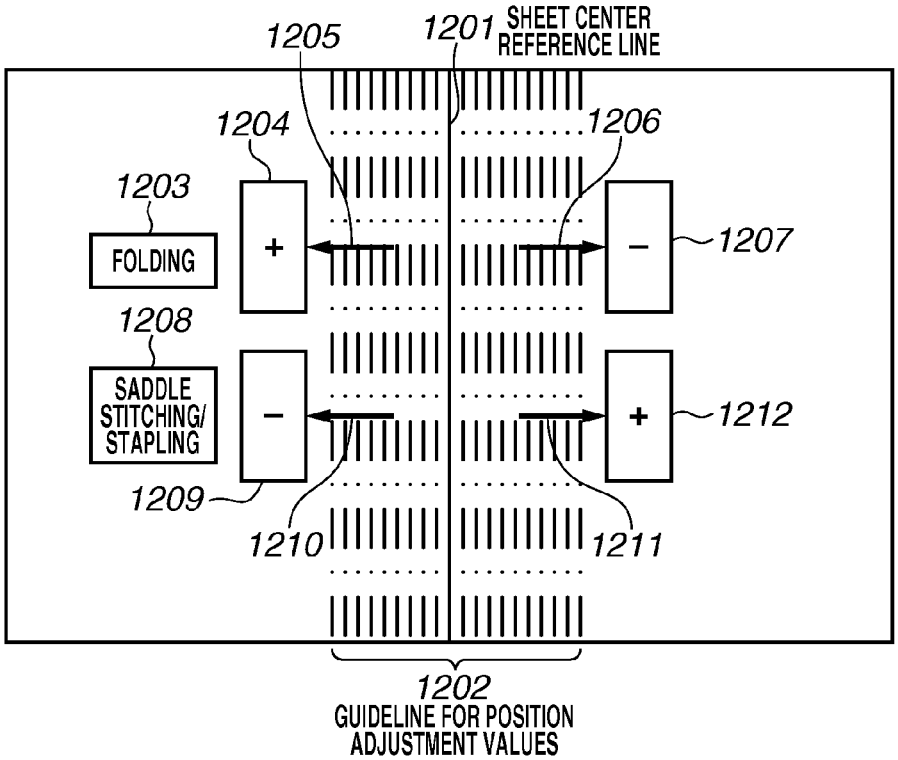
FIGS. 9A and 9B each illustrate an example of an adjustment sheet image.
Figure 9B:
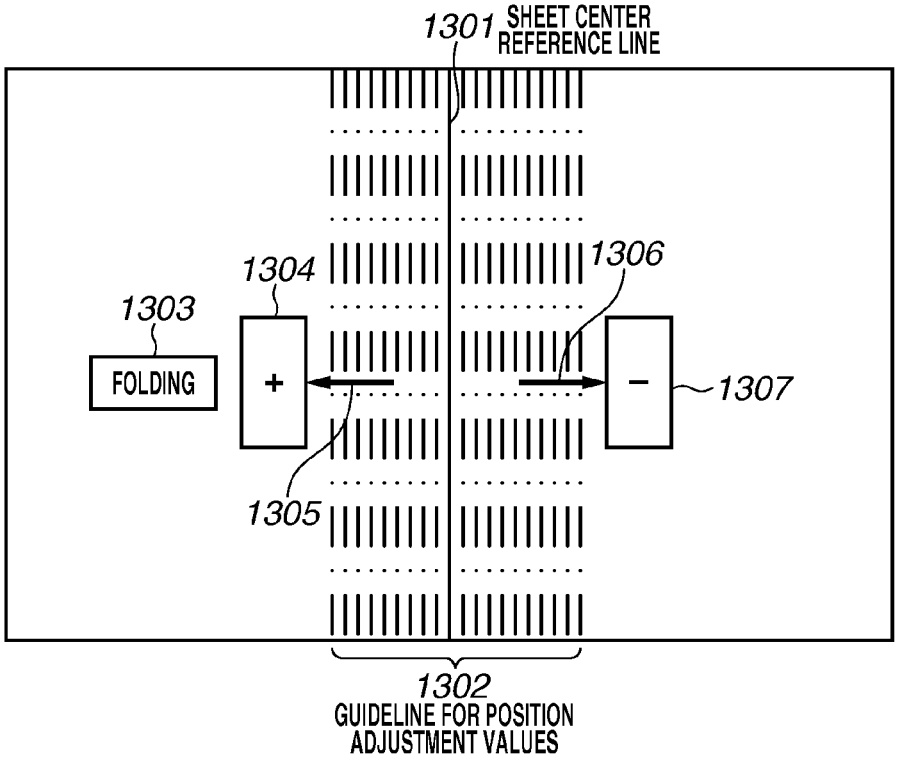

FIGS. 9A and 9B each illustrate an example of an adjustment sheet image suitable for the sheet processing devices according to the present exemplary embodiment. Especially, FIG. 9A illustrates an example of a dedicated adjustment sheet image generated in step S517 for the adjustment of the folding position and the saddle stitching/stapling position.

In FIG. 9A, a sheet center reference line 1201 is a reference for the adjustment of the folding position and the saddle stitching/stapling position.

Guidelines 1202 for reading a position adjustment value are spaced 1 mm apart. The number of guidelines 1202 corresponds to the position adjustment ranges of the folding processing and the saddle stitching/stapling processing that are stored in the management table (FIG. 4), with the sheet center reference line (1201) being the center. Sections 1203 and 1208 respectively indicate the sheet output processing functions that the adjustment values are for. Sections 1204, 1207, 1209, and 1212 each indicate a plus (+) or minus (−), each of which indicates the direction of the guideline adjustment value. Arrows 1205, 1206, 1210, and 1211 each explicitly indicate the plus/minus direction of the guideline adjustment value. Then, the processing proceeds to step S521, and the subsequent processing is performed as described above.

On the other hand, in step S514, if the CPU 305 determines that the saddle stitching function is not executable (NO in step S514), the processing proceeds to step S515. Then, in step S515, the CPU 305 determines whether the creasing function is executable. If the CPU 305 determines that the creasing function is not executable (NO in step S515), the processing proceeds to step S520.

Then, in step S520, the CPU 305 generates a dedicated adjustment sheet image for the adjustment of the folding position based on the sheet output processing position adjustment control unit 329, the image processing unit 317, and the information stored in the management table (FIG. 4).

FIG. 9B illustrates an example of a dedicated adjustment sheet image generated in step S520 for the adjustment of the folding position.

In FIG. 9B, a sheet center reference line 1301 is a reference for the adjustment of the folding position. Guidelines 1302 for reading a position adjustment value are spaced 1 mm apart. The number of guidelines 1302 corresponds to the position adjustment range of the folding processing that is stored in the management table (FIG. 4), with the sheet center reference line (1301) being the center. A section 1303 indicates the sheet output processing function that the adjustment value is for. Sections 1304 and 1307 each indicate a plus (+) or minus (−), each of which indicates the direction of the guideline adjustment value. Arrows 1305 and 1306 each explicitly indicate the plus/minus direction of the guideline adjustment value. Then, the processing proceeds to step S521, and the subsequent processing is performed as described above.

On the other hand, in step S515, if the CPU 305 determines that the creasing function is executable (YES in step S515), the processing proceeds to step S519.

Then, in step S519, the CPU 305 generates a dedicated adjustment sheet image for the adjustment of the folding position and the creasing position based on the sheet output processing position adjustment control unit 329, the image processing unit 317, and the information stored in the management table (FIG. 4).

FIG. 8B illustrates an example of a dedicated adjustment sheet image generated in step S519 for the adjustment of the folding position and the creasing position.

In FIG. 8B, a sheet center reference line 1101 is a reference for the adjustment of the folding position and the creasing position. Guidelines 1102 for reading a position adjustment value are spaced 1 mm apart. The number of guidelines 1102 corresponds to the position adjustment range of the folding processing that is stored in the management table (FIG. 4), with the sheet center reference line (1101) being the center. Sections 1103 and 1108 respectively indicate the sheet output processing functions that the adjustment values are for. Sections 1104, 1107, 1109, and 1112 each indicate a plus (+) or minus (−), each of which indicates the direction of the guideline adjustment value. Arrows 1105, 1106, 1110, and 1111 each explicitly indicate the plus/minus direction of the guideline adjustment value. Then, the processing proceeds to step S521, and the subsequent processing is performed as described above.

According to the present exemplary embodiment, an adjustment image for the position adjustment is automatically and dynamically generated from the sheet processing devices connected to the printing apparatus so that the test printing for the position adjustment of various types of sheet output processing (sheet processing) can be performed.

A second exemplary embodiment will describe an example in which a position adjustment image for a particular sheet output processing function is generated separately from a position adjustment image for other sheet output processing functions among multiple sheet output processing functions having the same reference position of the position adjustment so that the generated position adjustment images can be printed separately on front and back surfaces of a sheet during the adjustment test image printing.

In the present exemplary embodiment, methods of processing a combination of creasing and folding can be divided into two types, mountain folding and valley folding, according to the direction of folding following the creasing processing. The mountain folding is a method of folding a sheet such that the sheet forms a mountain in the direction in which a creasing die is pressed. The valley folding is a method of folding a sheet such that the sheet forms a valley in the direction to which a creasing die is pressed.

Figure 12:
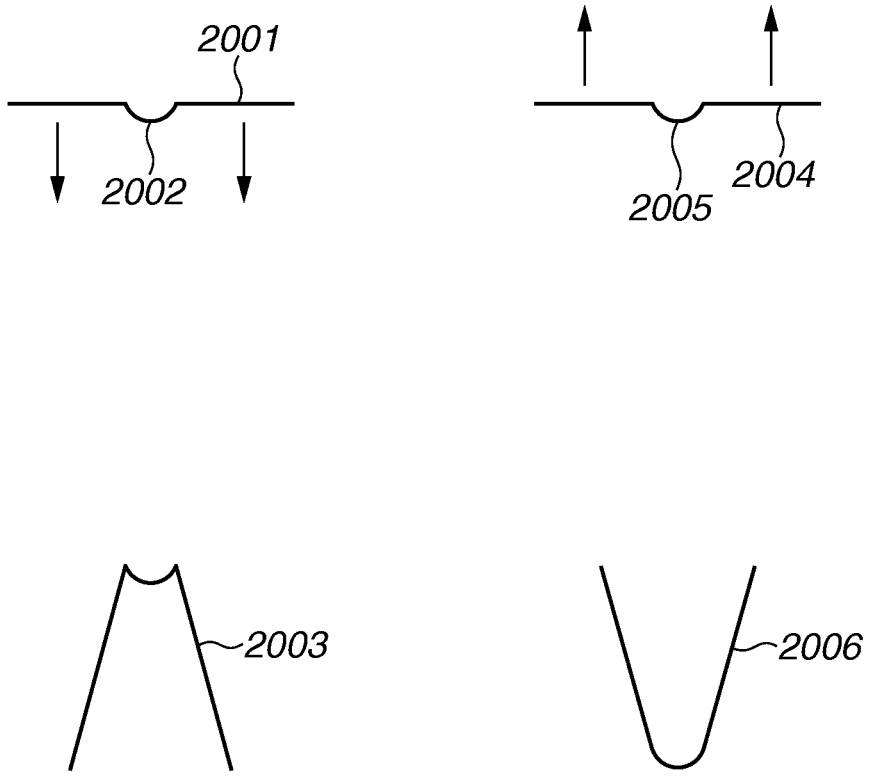
FIG. 12 illustrates the shapes of folds formed by creasing.

The following describes a method of folding after the creasing, with reference to FIG. 12.

As illustrated in FIG. 12, there are two methods, mountain folding and valley folding, depending on the direction of folding following the creasing.

In FIG. 12, a method of folding a sheet such that the sheet forms a mountain in the direction in which a die 205 is pressed is the mountain folding. In FIG. 12, a state 2001 shows the state of a creased sheet, and a state 2002 shows the state of a crease formed by the dies 205 and 206. A state 2003 shows the state of a mountain fold. A method of folding a sheet such that the sheet forms a valley in the direction in which the die 205 is pressed is the valley folding. A state 2004 shows the state of a creased sheet. A state 2005 shows the state of a crease formed by the dies 205 and 206. A state 2006 shows the state of a valley fold.

In a case where the folding is performed by mountain folding, the surface to be creased when the adjustment test image printing is executed is an outer surface of the sheet. Thus, the user can read the position adjustment value with ease if the creasing adjustment test image is printed on the outer surface of the sheet.

Hence, in the present exemplary embodiment, a position adjustment image for the creasing function is generated separately from a position adjustment image for other sheet output processing functions by a method of processing a combination of creasing and folding.

Figure 13:
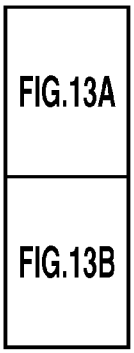
FIG. 13, which includes
Figure 13A:
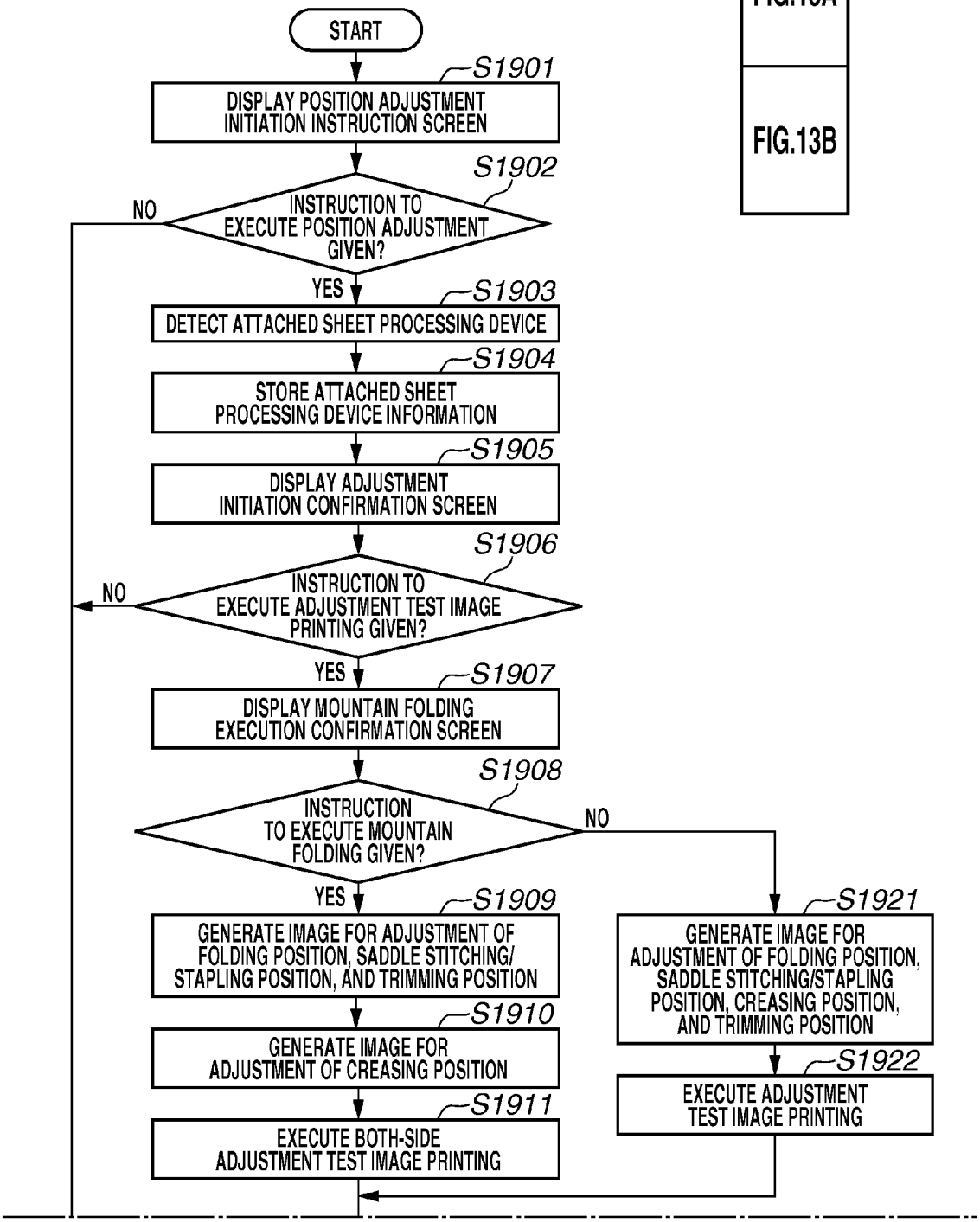
FIG. 13A and FIG. 13B, is a flow chart illustrating a method of controlling a printing apparatus.

FIG. 13 is a flow chart illustrating a method of controlling a printing apparatus according to the present exemplary embodiment. The CPU 305 executes a stored control program to realize each step.

In step S1901, the CPU 305 instructs the operation unit 104 via the operation unit I/F 307 to display a screen (FIG. 10A) for giving an instruction on whether to execute the position adjustment of the sheet output processing function. Then, in step S1902, the CPU 305 determines whether an instruction to execute the position adjustment has been given. If the CPU 305 determines that an instruction to execute the position adjustment has not been given (NO in step S1902), the processing ends.

On the other hand, if the CPU 305 determines that an instruction to execute the position adjustment has been given (YES in step S1902), the processing proceeds to step S1903, and the CPU 305 detects the sheet processing devices that are currently attached and the sheet output processing functions of the attached sheet processing devices and acquires related information under the control by the sheet output control unit 328 and the sheet output processing position adjustment control unit 329.

Information to be acquired in step S1903 includes the sheet processing devices that are connected, the sheet output processing functions of the sheet processing devices, the statuses of the sheet output processing functions, information on the position adjustment ranges of the sheet output processing functions, sheet reference positions for the position adjustment, and the position adjustment settability by the printing apparatus 100.

Next, in step S1904, the CPU 305 stores the detected sheet processing devices, the sheet output processing functions, and the related information in the management table (FIG. 4).

Then, based on the information stored in the management table, the CPU 305 generates an adjustment sheet image for the position adjustment of a sheet output processing function that corresponds to an executable sheet output processing function detected in subsequent processing. The following describes the processing using the management table illustrated in FIG. 4 as an example.

In step S1905, the CPU 305 instructs the operation unit 104 via the operation unit I/F 307 to display a screen (FIG. 10B) for selecting whether to execute the adjustment test image printing in which the sheet output processing functions are performed using as an adjustment sheet image the image for the position adjustment of the sheet output processing functions that are executable this time.

In the present control example, the sheet output processing functions are the folding processing, the saddle stitching/stapling processing, the creasing processing, and the trimming processing.

Then, in step S1906, the CPU 305 determines whether an instruction to execute the adjustment test image printing has been given. If the CPU 305 determines that an instruction to execute the adjustment test image printing has not been given (NO in step S1906), the processing ends.

Figure 16:
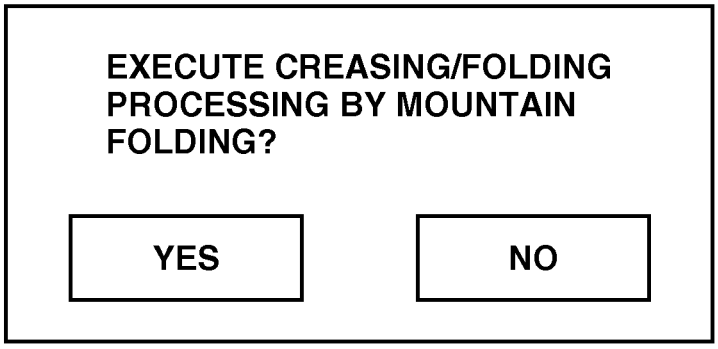
FIG. 16 illustrates an example of a UI screen displayed on a printing apparatus.

On the other hand, if the CPU 305 determines that an instruction to execute the adjustment test image printing has been selected (YES in step S1906), the processing proceeds to step S1907. Then, in step S1907, the CPU 305 instructs the operation unit 104 to display a screen (FIG. 16) for selecting whether to execute the creasing/folding processing by mountain folding in the current adjustment test image printing. Then, in step S1908, the CPU 305 determines whether an instruction to execute the mountain folding has been given. If the CPU 305 determines that an instruction to execute the mountain folding has been given (YES in step S1908), the processing proceeds to step S1909.

Then, in step S1909, the CPU 305 generates a dedicated adjustment sheet image for the adjustment of the folding position, the saddle stitching/stapling position, and the trimming position based on the sheet output processing position adjustment control unit 329, the image processing unit 317, and the information stored in the management table (FIG. 4).

Figure 14A:
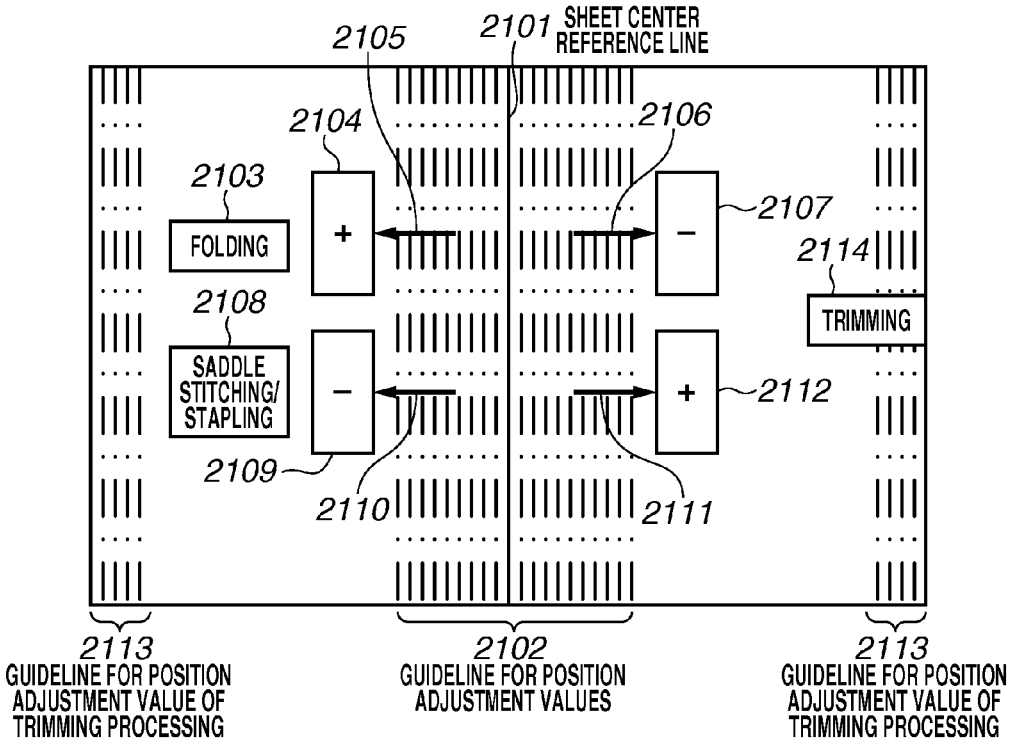
FIGS. 14A and 14B each illustrate an example of an adjustment sheet settings screen.
Figure 14B:
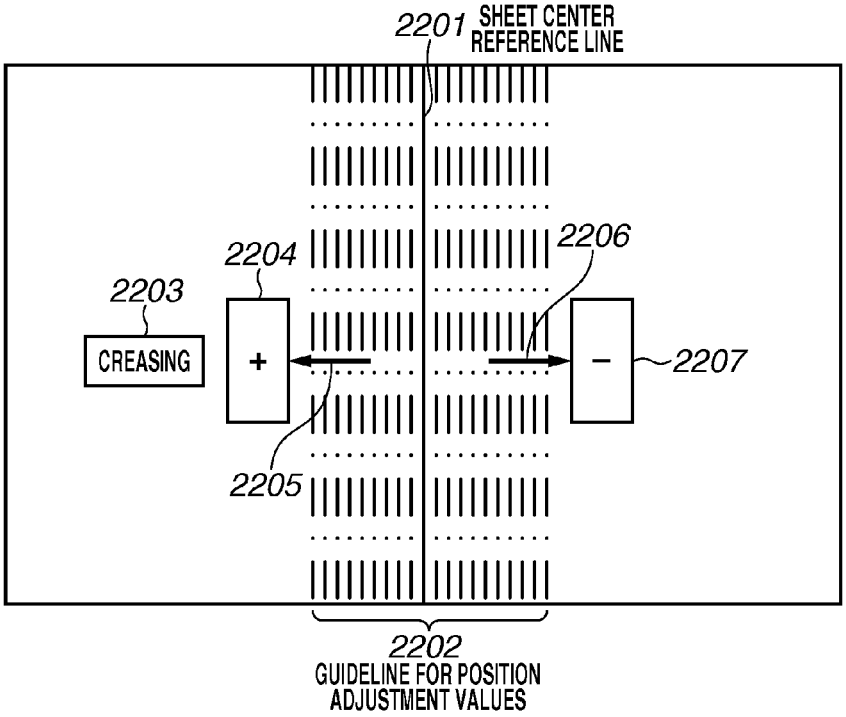

FIGS. 14A and 14B each illustrate an example of an adjustment sheet image suitable for the sheet processing devices according to the present exemplary embodiment. Especially, FIG. 14A illustrates an example of a dedicated adjustment sheet image for the adjustment of the folding position, the saddle stitching/stapling position, and the trimming position that is generated in step S1909.

In FIG. 14A, a sheet center reference line 2101 is a reference for the adjustment of the folding position and the saddle stitching/stapling position.

Guidelines 2102 for reading a position adjustment value are spaced 1 mm apart. The number of guidelines 2102 corresponds to the adjustment ranges of the folding position and the saddle stitching/stapling position that are stored in the management table (FIG. 4), with the sheet center reference line (2101) being the center. Sections 2103, 2108, and 2114 respectively indicate the sheet output processing functions that the adjustment values are for. Sections 2104, 2107, 2109, and 2112 each indicate a plus (+) or minus (−), each of which indicates the direction of the guideline adjustment value. Arrows 2105, 2106, 2110, and 2111 each explicitly indicate the plus/minus direction of the guideline adjustment value.

Guidelines 2113 for reading a position adjustment value of the trimming processing are spaced 1 mm apart. The number of guidelines 2113 corresponds to the adjustment ranges of the folding position and the trimming position that are stored in the management table (FIG. 4), with a sheet edge being a reference.

Next, the processing proceeds to step S1910, and the CPU 305 generates a dedicated adjustment sheet image for the adjustment of the creasing position based on the sheet output processing position adjustment control unit 329, the image processing unit 317, and the information stored in the management table (FIG. 4).

FIG. 14B illustrates an example of a dedicated adjustment sheet image generated in step S1910 for the adjustment of the creasing position.

In FIG. 14B, a sheet center reference line 2201 is a reference for the adjustment of the creasing position. Guidelines 2202 for reading a position adjustment value are spaced 1 mm apart. The number of guidelines 2202 corresponds to the adjustment range of the creasing position that is stored in the management table (FIG. 4), with the sheet center reference line (2201) being the center. A section 2203 indicates the sheet output processing function that the adjustment value is for.

Sections 2204 and 2207 each indicate a plus (+) or minus (−), each of which indicates the direction of the guideline adjustment value. Arrows 2205 and 2206 each explicitly indicate the plus/minus direction of the guideline adjustment value.

Then, in step S1911, the CPU 305 executes the adjustment test image printing in which the mountain folding processing, the saddle stitching/stapling processing, the creasing processing, and the trimming processing are performed using the generated adjustment sheet images under the control by the job control unit 325, the sheet output control unit 328, and the image processing unit 317.

In the adjustment test image printing, the dedicated adjustment sheet image (FIG. 14A) for the adjustment of the folding position, the saddle stitching/stapling position, and the trimming position is assigned to a back surface and executed, and the dedicated adjustment sheet image (FIG. 14B) for the adjustment of the creasing position is assigned to a front surface and executed.

Figure 15:
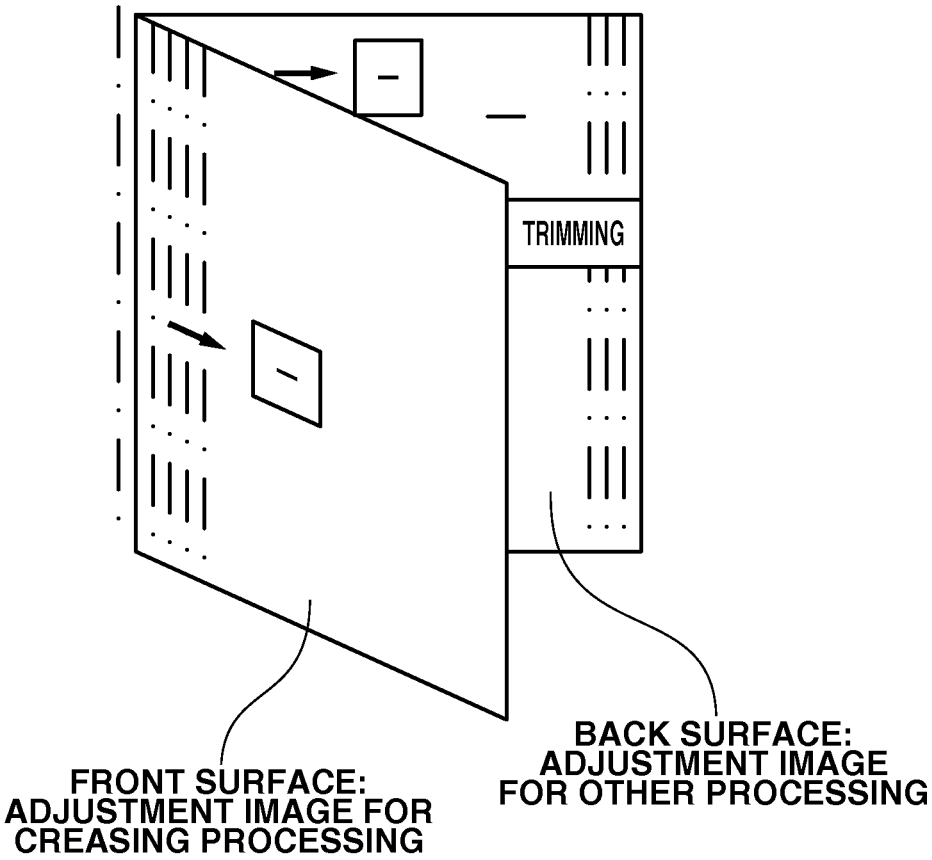
FIG. 15 illustrates an example of an adjustment sheet image.

FIG. 15 illustrates an example of an adjustment sheet image suitable for the sheet processing devices according to the present exemplary embodiment. This is an example in which the results of the adjustment test image printing in FIGS. 14A and 14B are printed on back and front surfaces of a sheet.

On the other hand, in step S1908, if the CPU 305 determines that an instruction to execute the mountain folding has not been given (NO in step S1908), the processing proceeds to step S1921. Then, in step S1921, the CPU 305 generates a dedicated adjustment sheet image for the adjustment of the folding position, the saddle stitching/stapling position, the creasing position, and the trimming position based on the sheet output processing position adjustment control unit 329, the image processing unit 317, and the information stored in the management table (FIG. 4).

FIG. 6A illustrates an example of a dedicated adjustment sheet image generated in step S1921 for the adjustment of the folding position, the saddle stitching/stapling position, the creasing position, and the trimming position.

In FIG. 6A, the sheet center reference line 601 is a reference for the adjustment of the folding position, the saddle stitching/stapling position, and the creasing position. The guidelines 602 for reading a position adjustment value are spaced 1 mm apart. The number of guidelines 602 corresponds to the adjustment ranges of the folding position, the saddle stitching/stapling position, and the creasing position that are stored in the management table (FIG. 4), with the sheet center reference line (601) being the center. The sections 603, 608, 613, and 618 respectively indicate the sheet output processing functions that the adjustment values are for. The sections 604, 607, 609, 612, 614, and 617 each indicate a plus (+) or minus (−), each of which indicates the direction of the guideline adjustment value. The arrows 605, 606, 610, 611, 615, and 616 each explicitly indicate the plus/minus direction of the guideline adjustment value.

The guidelines 619 for reading a position adjustment value of the trimming processing are spaced 1 mm apart. The number of guidelines 619 corresponds to the adjustment ranges of the folding position and the trimming position that are stored in the management table (FIG. 4), with a sheet edge being a reference.

Then, in step S1922, the CPU 305 instructs the operation unit 104 to display a screen (FIG. 10B) for selecting whether to execute the adjustment test image printing in which the sheet output processing functions are performed using as an adjustment sheet image the image for the position adjustment of the sheet output processing functions that are determined as being executable this time. In the present control example, the sheet output processing functions are the folding processing, the saddle stitching/stapling processing, the creasing processing, and the trimming processing.

Then, the CPU 305 determines whether an instruction to execute the adjustment test image printing has been given. If an instruction to execute the adjustment test image printing has not been given, the processing ends.

On the other hand, if the CPU 305 determines that an instruction to execute the adjustment test image printing has not been selected, the processing proceeds to step S523 and the subsequent steps.

Then, the CPU 305 executes the adjustment test image printing in which the folding processing, the saddle stitching/stapling processing, the creasing processing, and the trimming processing are executed using the generated adjustment sheet image (FIG. 6A) under the control by the job control unit 325, the sheet output control unit 328, and the image processing unit 317.

Figure 5B:
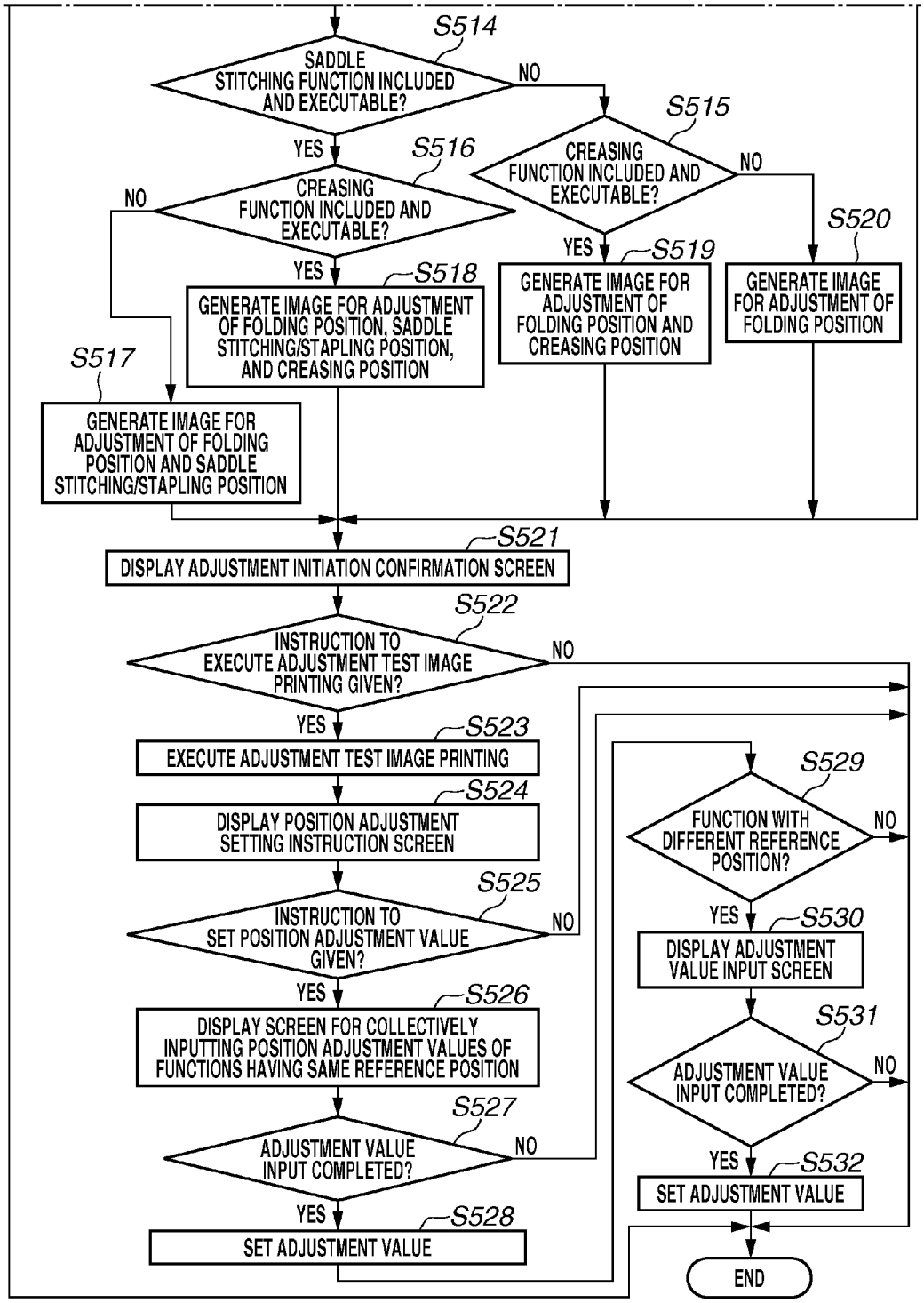
Figure 13B:
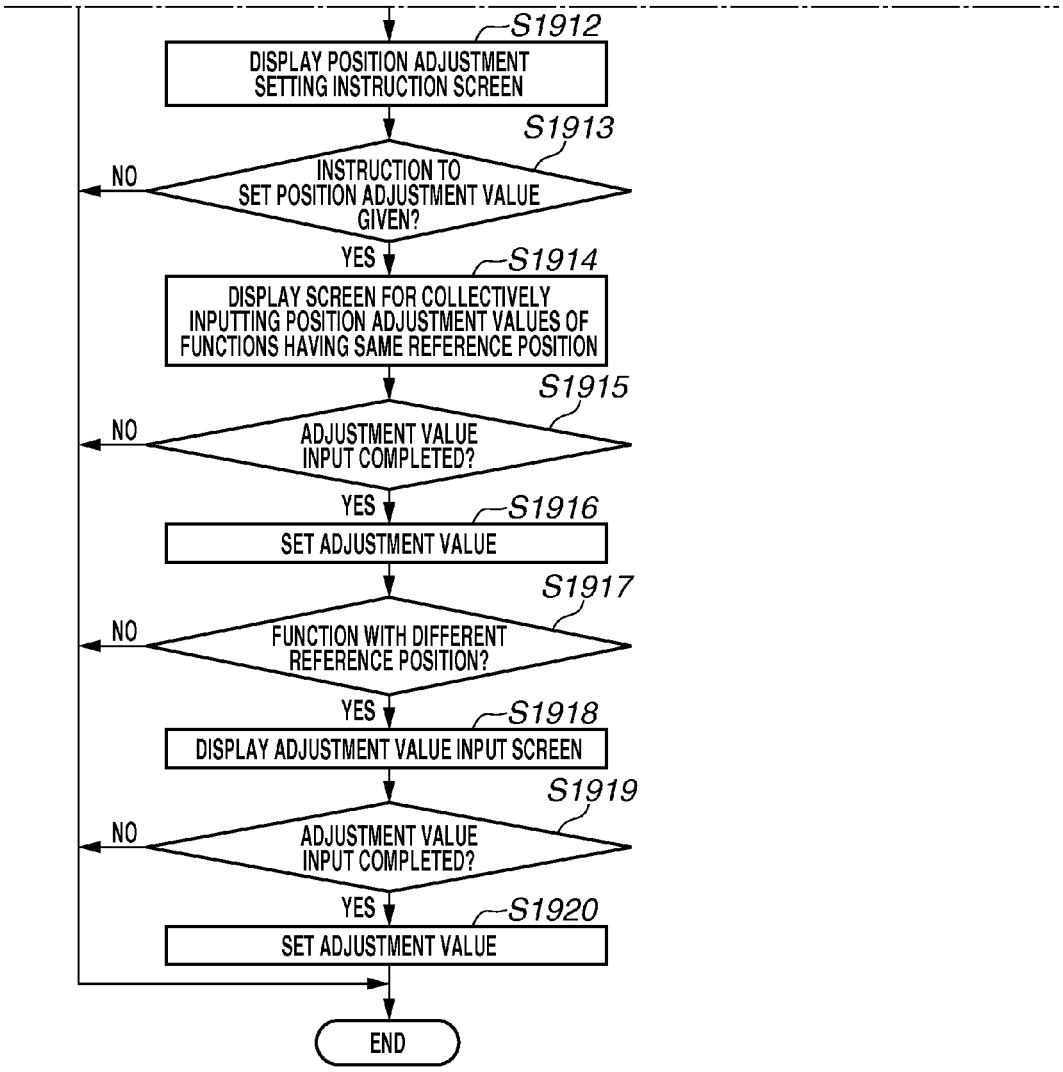

Then, the processing proceeds to step S1912, and the steps S1912 through S1920 (FIG. 13B) are similar to step S524 and the subsequent steps (FIG. 5B) in the first exemplary embodiment, so description thereof is omitted.

As the foregoing describes, according to the present exemplary embodiment, in a case of the adjustment of the creasing position and the folding position that requires an adjustment to align their processing positions to the same reference position, the respective adjustment values are to be read from the scales printed on different surfaces. Thus, the user can read the position adjustment values more easily.

A third exemplary embodiment will describe an example in which in a case where the position adjustment cannot be set from the printing apparatus 100 to some of the sheet processing devices connected to the printing apparatus 100, even if the sheet reference position of the position adjustment is the same, an adjustment value setting instruction method is changed.

In the present exemplary embodiment, the creaser 200 is the sheet processing device to which the position adjustment cannot be set from the printing apparatus 100.

Figure 17:
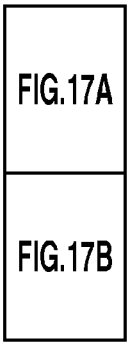
FIG. 17, which includes
Figure 17A:
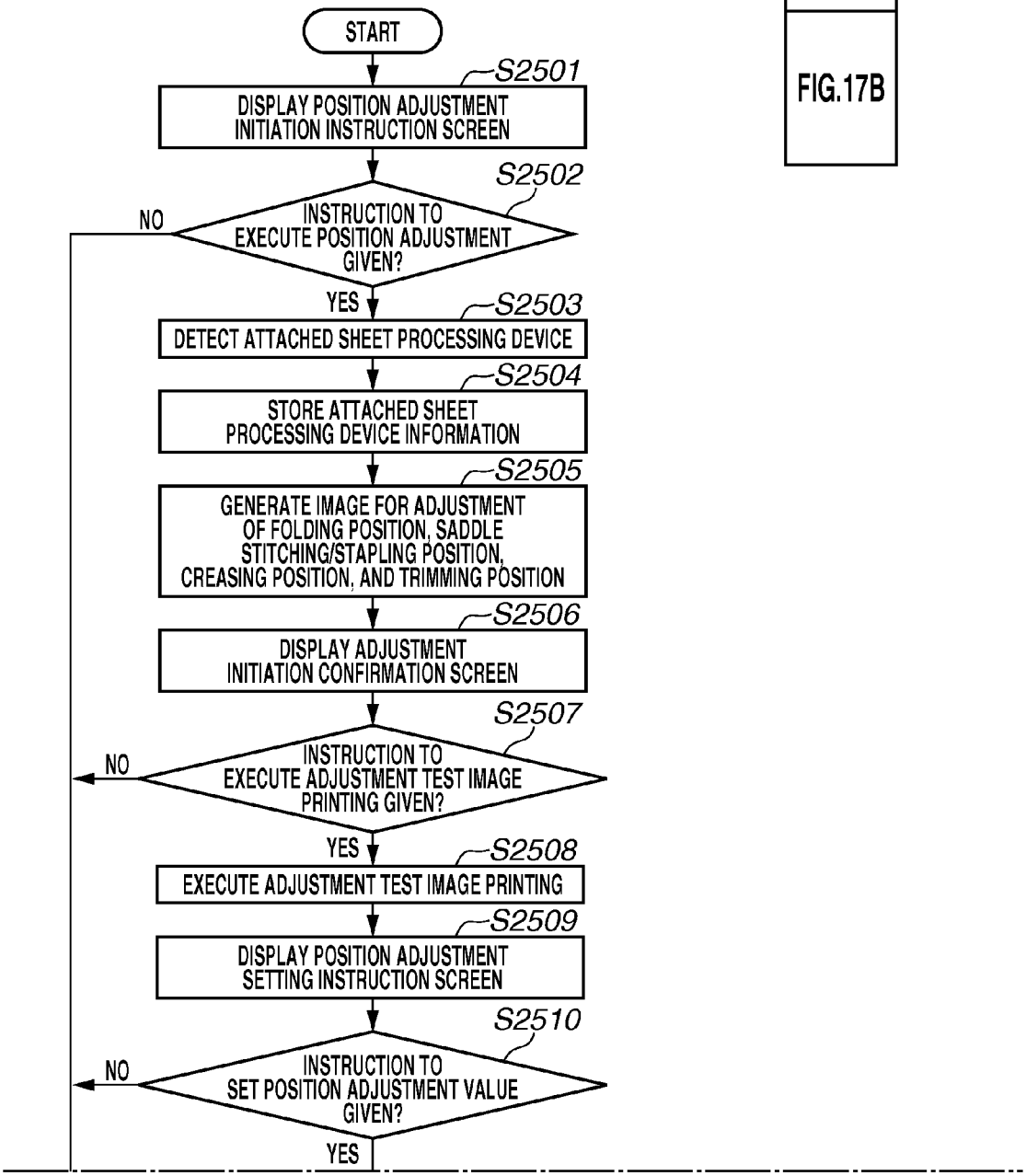
FIG. 17A and FIG. 17B, is a flow chart illustrating a method of controlling a printing apparatus.
Figure 17B:
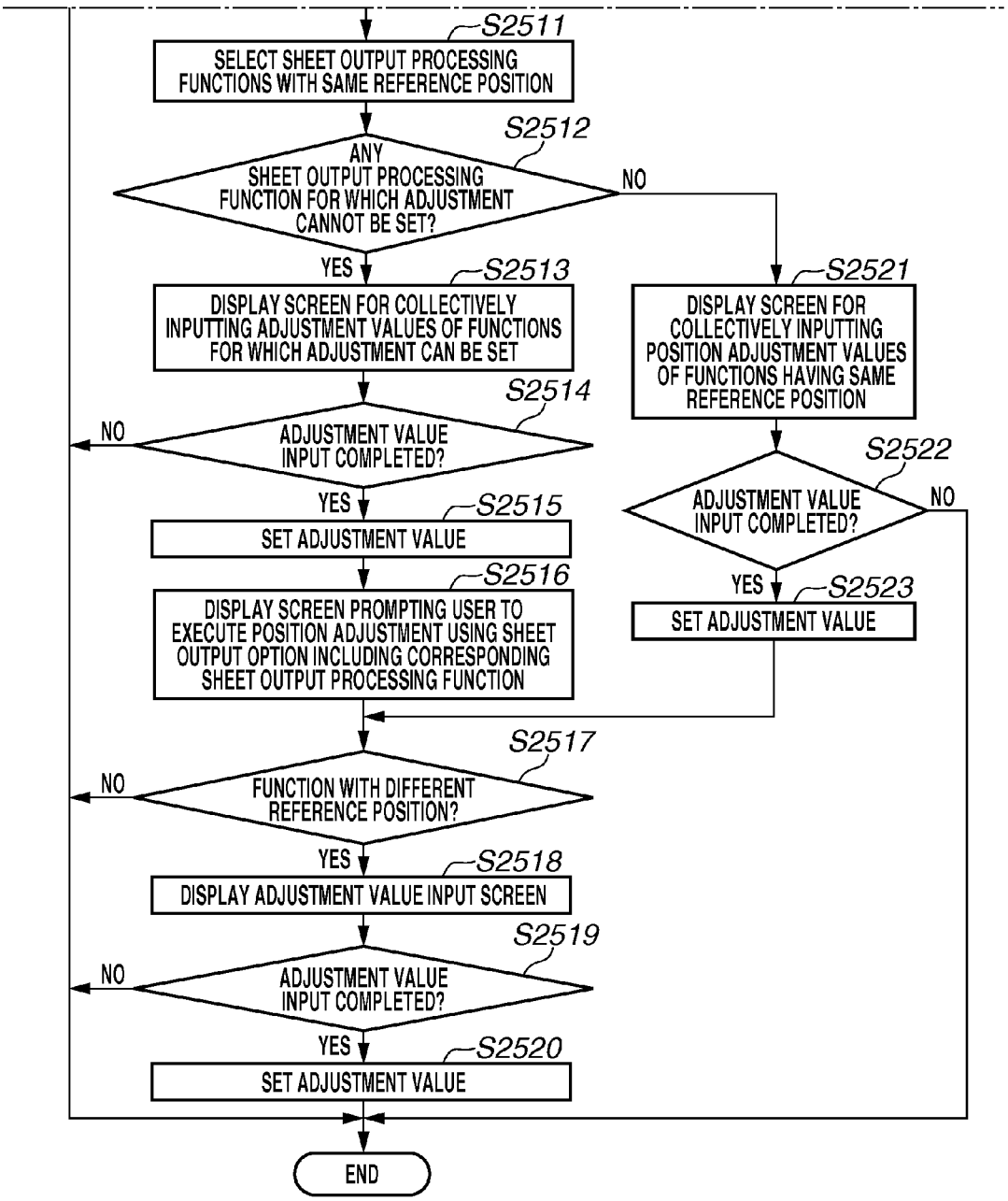

FIG. 17 is a flow chart illustrating a method of controlling a printing apparatus according to the present exemplary embodiment. The CPU 305 executes a stored control program to realize each step.

In step S2501, the CPU 305 instructs the operation unit 104 via the operation unit I/F 307 to display a screen (FIG. 10A) for giving an instruction on whether to execute the position adjustment of the sheet output processing function. Then, in step S2502, the CPU 305 determines whether an instruction to execute the position adjustment has been given. If the CPU 305 determines that an instruction to execute the position adjustment has not been given (NO in step S2502), the processing ends.

On the other hand, if the CPU 305 determines that an instruction to execute the position adjustment has been given (YES in step S2502), the processing proceeds to step S2503, and the CPU 305 detects the sheet processing devices that are currently attached and the sheet output processing functions of the attached sheet processing devices and acquires related information under the control by the sheet output control unit 328 and the sheet output processing position adjustment control unit 329.

Information to be acquired in step S2503 includes the sheet processing devices that are connected, the sheet output processing functions of the sheet processing devices, the statuses of the sheet output processing functions, information on the position adjustment ranges of the sheet output processing functions, sheet reference positions for the position adjustment, and the position adjustment settability by the printing apparatus 100.

Next, in step S2504, the CPU 305 stores the detected sheet processing devices, the sheet output processing functions, and the related information in the management table (FIG. 18).

Then, based on the information stored in the management table illustrated in FIG. 18, the CPU 305 generates an adjustment sheet image for the position adjustment of a sheet output processing function that corresponds to an executable sheet output processing function detected in subsequent processing. The following describes the processing using the management table illustrated in FIG. 18 as an example.

In step S2505, the CPU 305 generates a dedicated adjustment sheet image for the adjustment of the folding position, the saddle stitching/stapling position, the creasing position, and the trimming position based on the sheet output processing position adjustment control unit 329, the image processing unit 317, and the information stored in the management table (FIG. 18).

FIG. 6A illustrates an example of a dedicated adjustment sheet image generated in step S2505 for the adjustment of the folding position, the saddle stitching/stapling position, the creasing position, and the trimming position.

In FIG. 6A, the sheet center reference line 601 is a reference for the adjustment of the folding position, the saddle stitching/stapling position, and the creasing position.

The guidelines 602 for reading a position adjustment value are spaced 1 mm apart. The number of guidelines 602 corresponds to the adjustment ranges of the folding position, the saddle stitching/stapling position, and the creasing position that are stored in the management table (FIG. 4), with the sheet center reference line (601) being the center. The sections 603, 608, 613, and 618 respectively indicate the sheet output processing functions that the adjustment values are for. The sections 604, 607, 609, 612, 614, and 617 each indicate a plus (+) or minus (−), each of which indicates the direction of the guideline adjustment value. The arrows 605, 606, 610, 611, 615, and 616 each explicitly indicate the plus/minus direction of the guideline adjustment value.

The guidelines 619 for reading a position adjustment value of the trimming processing are spaced 1 mm apart. The number of guidelines 619 corresponds to the adjustment ranges of the folding position and the trimming position that are stored in the management table (FIG. 4), with a sheet edge being a reference.

In step S2506, the CPU 305 instructs the operation unit 104 to display a screen (FIG. 10B) for selecting whether to execute the adjustment test image printing in which the sheet output processing functions are performed using as an adjustment sheet image the image for the position adjustment of the sheet output processing functions that are determined as being executable this time. In the present control example, the sheet output processing functions are the folding processing, the saddle stitching/stapling processing, the creasing processing, and the trimming processing.

Then, in step S2507, the CPU 305 determines whether an instruction to execute the adjustment test image printing has been given. If the CPU 305 determines that an instruction to execute the adjustment test image printing has not been given (NO in step S2507), the processing ends. On the other hand, in step S2507, if the CPU 305 determines that an instruction to execute the adjustment test image printing has been given (YES in step S2507), the processing proceeds to step S2508.

Then, in step S2508, the CPU 305 executes the adjustment test image printing in which the folding processing, the saddle stitching/stapling processing, the creasing processing, and the trimming processing are performed using the generated adjustment sheet image (FIG. 6A) under the control by the job control unit 325, the sheet output control unit 328, and the image processing unit 317.

Next, in step S2509, the CPU 305 displays on the operation unit 104 via the operation unit I/F 307 a screen (FIG. 10C) for selecting whether to set an adjustment value from the printed adjustment test image.

Then, in step S2510, the CPU 305 determines whether an instruction to set a position adjustment value has been given. If the CPU 305 determines that an instruction to set a position adjustment value has not been given (NO in step S2510), the processing ends. On the other hand, in step S2510, if the CPU 305 determines that an instruction to set a position adjustment value has been given (YES in step S2510), the processing proceeds to step S2511, and the CPU 305 selects from the management table (FIG. 18) all sheet output processing functions that have the same reference position of the position adjustment under the control by the sheet output processing position adjustment control unit 329.

Then, the processing proceeds to step S2512, and the CPU 305 determines from the management table (FIG. 18) whether there is any sheet output processing function for which the adjustment cannot be set under the control by the sheet output processing position adjustment control unit 329. If the CPU 305 determines that there is any sheet output processing function for which the adjustment cannot be set (YES in step S2512), the processing proceeds to step S2513.

Then, the processing proceeds to step S2513, and the CPU 305 displays on the operation unit 104 a screen for collectively inputting the adjustment values of the sheet output processing functions with the same reference position of the position adjustment for which the adjustment can be set from the management table (FIG. 18) under the control by the sheet output processing position adjustment control unit 329.

Figure 19:
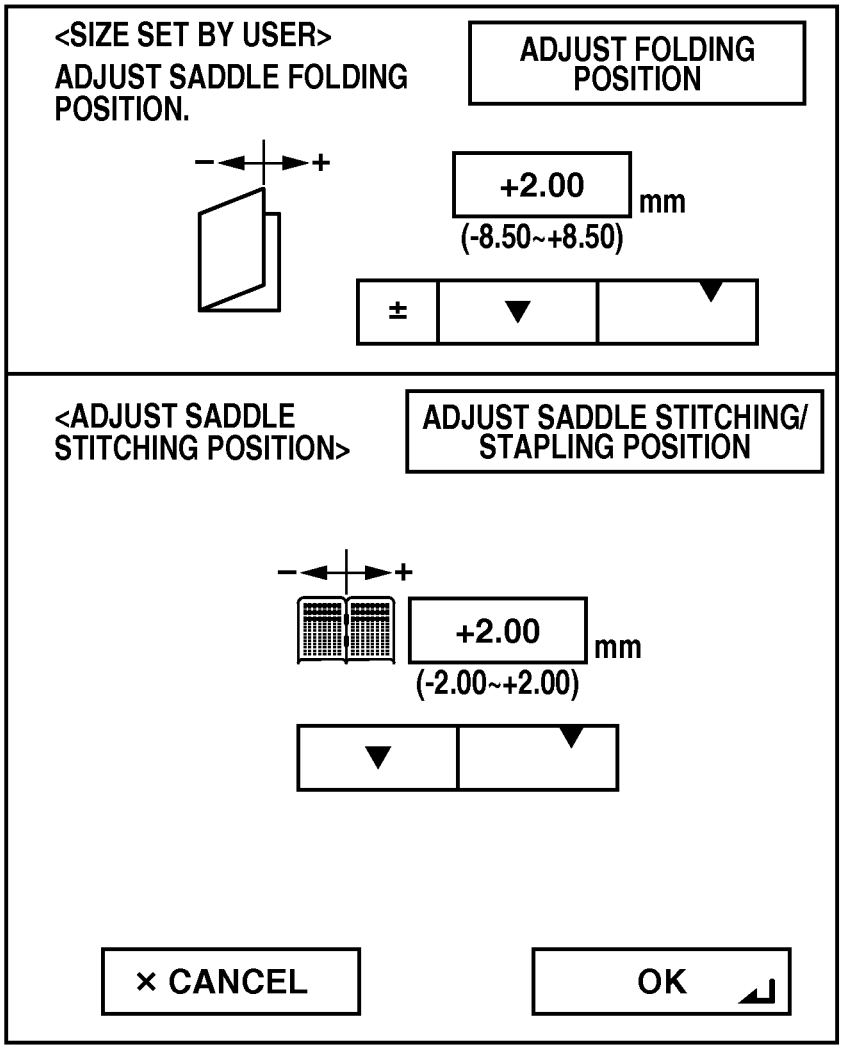
FIG. 19 illustrates an example of a UI screen displayed on a printing apparatus.

In the present control example, a screen (FIG. 19) that collectively displays the settings for the folding processing and the saddle stitching/stapling processing, which have the same sheet center reference and for which the adjustment can be set, is displayed. Then, in step S2514, the CPU 305 determines whether the input of the adjustment values from the operation unit 104 via the operation unit I/F 307 is completed. If the CPU 305 determines that no position adjustment value has been input, the processing ends.

On the other hand, in step S2514, if the CPU 305 determines that the input of the position adjustment values is completed (YES in step S2514), then in step S2515, the CPU 305 sets the input adjustment values to the sheet processing devices under the control by the sheet output control unit 328 and the sheet output processing position adjustment control unit 329. In the present control example, the position adjustment values of the folding processing and the saddle stitching/stapling processing are set to the finisher 210.

Next, the processing proceeds to step S2516, and the CPU 305 selects from the management table (FIG. 18) under the control by the sheet output processing position adjustment control unit 329 a sheet output processing function for which the adjustment cannot be set. Then, the CPU 305 displays on the operation unit 104 via the operation unit I/F 307 a screen (FIG. 20) that prompts the user to execute the position adjustment with a sheet output option that includes the corresponding sheet output processing function.

In the present control example, a screen (FIG. 14B) that prompts the user to set the adjustment value of the creasing position with a UI of the sheet processing device (creaser 200).

In step S2517, the CPU 305 determines from the management table (FIG. 18) stored in the sheet output processing device control information storage unit 330 whether there is a sheet output processing functions with a different reference position of the position adjustment from the reference position in step S526 under the control by the sheet output processing position adjustment control unit 329. If the CPU 305 determines that there are no sheet output processing functions with a different reference position (NO in step S2517), the processing ends.

On the other hand, in step S2517, there is a sheet output processing functions with a different reference position (YES in step S2517), the processing proceeds to step S2518, and the CPU 305 displays on the operation unit 104 via the operation unit I/F 307 a screen for inputting an adjustment value of the sheet output processing function having a different reference position of the position adjustment from the management table (FIG. 18). In the present control example, the trimming processing with the sheet edge reference is the sheet output processing function having a different reference position, and the screen illustrated in FIG. 11B is displayed.

In step S2519, the CPU 305 determines whether the input of the adjustment value from the operation unit 104 via the operation unit I/F 307 is completed. If the CPU 305 determines that no position adjustment value has been input (NO in step S2519), the processing ends.

On the other hand, in step S2519, if the CPU 305 determines that the input of the position adjustment value has been completed (YES in step S2519), the processing proceeds to step S2520. In step S2520, the CPU 305 sets the input adjustment values to the corresponding sheet processing devices via the device I/F 316 under the control by the sheet output control unit 328 and the sheet output processing position adjustment control unit 329. In the present control example, the position adjustment value of the trimming processing is set to the trimmer 230.

On the other hand, in step S2512, if the CPU 305 determines that there is no sheet output processing function for which the adjustment cannot be set (NO in step S2512), the processing proceeds to step S2521.

Then, the CPU 305 selects from the management table (FIG. 18) stored in the sheet output processing device control information storage unit 330 all sheet output processing functions that have the same reference position under the control by the sheet output processing position adjustment control unit 329. Then, the CPU 305 displays on the operation unit 104 via the operation unit I/F 307 a screen for collectively inputting the adjustment values of the selected sheet output processing functions having the same reference position of the position adjustment.

In the present control example, a screen (FIG. 11A) that collectively displays the settings for the folding processing, the saddle stitching/stapling processing, and the creasing processing, all of which have the same sheet center reference, is displayed. Then, in step S2522, the CPU 305 determines whether the input of the adjustment values from the operation unit 104 via the operation unit I/F 307 is completed. If the CPU 305 determines that no position adjustment value is input (NO in step S2522), the processing ends.

On the other hand, in step S2522, if the CPU 305 determines that the input of the position adjustment values is completed (YES in step S2522), then in step S2523, the CPU 305 sets the input adjustment values to the sheet processing devices under the control by the sheet output control unit 328 and the sheet output processing position adjustment control unit 329. In the present control example, the position adjustment values of the folding processing and the saddle stitching/stapling processing are set to the finisher 210. Then, the processing proceeds to step S2517, and the subsequent processing is performed as described above.

As the foregoing describes, according to the present exemplary embodiment, even if a sheet output processing device for which the position adjustment value of the sheet output processing cannot be set directly from the printing apparatus 100 is attached, an instruction on how to deal with the situation is displayed so that the user can adjust the positions more easily.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-034456 filed Feb. 25, 2014, which is hereby incorporated by reference herein in its entirety.

What is claimed is:

1. A printing apparatus which is able to connect with at least one of a plurality of types of sheet processing apparatuses, the printing apparatus comprising:

an acquisition unit configured to acquire information indicating a type of a sheet process which is able to be performed by a sheet processing apparatus connected with the printing apparatus;

a generation unit configured to generate an adjustment test image for adjusting a position of the sheet process performed by the sheet processing apparatus based on the information acquired by the acquisition unit; and a printing unit configured to print the adjustment test image generated by the generation unit.

2. The printing apparatus according to claim 1, further comprising:

a receiving unit configured to receive an adjustment value to be set to the sheet processing apparatus; and a setting unit configured to set the adjustment value received by the receiving unit to the sheet processing apparatus.

3. The printing apparatus according to claim 2, wherein the adjustment test image includes scales for allowing a user to determine the adjustment value.

4. The printing apparatus according to claim 2, wherein the adjustment test image includes scales for allowing a user to determine the adjustment value and indications indicating directions of an increase of the adjustment value and a decrease of the adjustment value.

5. The printing apparatus according to claim 1, wherein the generating unit generates a first adjustment test image and a second adjustment test image, wherein the printing unit prints, on a first side of a sheet, the first adjustment test image, and wherein the printing unit prints, on a second side of the sheet, the second adjustment test image.

6. The printing apparatus according to claim 1, wherein the printing apparatus is connected with a plurality of sheet processing apparatuses, wherein the acquisition unit acquires information indicating types of sheet processes which are able to be performed by the plurality of sheet processing apparatuses, and wherein the generating unit generates the adjustment test image for adjusting positions of the sheet processes performed by the plurality of sheet processing apparatuses based on the information acquired by the acquisition unit.

7. The printing apparatus according to claim 1, wherein the acquisition unit acquires the information from the sheet processing apparatus.

8. The printing apparatus according to claim 1, wherein the sheet processing apparatus includes at least one of a finishing apparatus which performs a saddle stitching process, a creasing apparatus which performs a creasing process, and a trimming apparatus which performs a trimming process.

9. A method of controlling a printing apparatus which is able to connect with at least one of a plurality of types of sheet processing apparatuses, the method comprising:

acquiring information indicating a type of a sheet process which is able to be performed by a sheet processing apparatus connected with the printing apparatus;

generating an adjustment test image for adjusting a position of the sheet process performed by the sheet processing apparatus based on the acquired information; and printing the generated adjustment test image.

10. A non-transitory storage medium storing a program for causing a computer to execute a method of controlling a printing apparatus which is able to connect with at least one of a plurality of types of sheet processing apparatuses, the method comprising:

acquiring information indicating a type of a sheet process which is able to be performed by a sheet processing apparatus connected with the printing apparatus;

generating an adjustment test image for adjusting a position of the sheet process performed by the sheet processing apparatus based on the acquired information; and printing the generated adjustment test image.

* * * * *